US009152070B2

(12) United States Patent
Ogiyama et al.

(10) Patent No.: US 9,152,070 B2
(45) Date of Patent: Oct. 6, 2015

(54) TRANSFER DEVICE AND IMAGE FORMING APPARATUS

(75) Inventors: Hiromi Ogiyama, Tokyo (JP); Tomokazu Takeuchi, Tokyo (JP); Yasunobu Shimizu, Kanagawa (JP); Kenji Sengoku, Kanagawa (JP); Hiroyoshi Haga, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 6 days.

(21) Appl. No.: 13/541,211

(22) Filed: Jul. 3, 2012

(65) Prior Publication Data

US 2013/0011155 A1 Jan. 10, 2013

(30) Foreign Application Priority Data

Jul. 4, 2011 (JP) ..... 2011-148540

(51) Int. Cl.
*G03G 15/14* (2006.01)
*G03G 15/01* (2006.01)
*G03G 15/16* (2006.01)

(52) U.S. Cl.
CPC ..... *G03G 15/0189* (2013.01); *G03G 15/1675* (2013.01); *G03G 2215/0129* (2013.01)

(58) Field of Classification Search
CPC ..... G03G 15/0189; G03G 15/1675; G03G 2215/00409
USPC ..... 399/88, 66.89, 297, 320, 308, 314
See application file for complete search history.

(56) References Cited

U.S. PATENT DOCUMENTS 4,528,937 A 7/1985 Kanno et al.
4,851,874 A 7/1989 Ogiyama
5,029,840 A 7/1991 Haga et al.
5,483,330 A 1/1996 Ogiyama et al.

(Continued)

FOREIGN PATENT DOCUMENTS

JP H09-050197 A 2/1997
JP 2004-29853 A 1/2004
JP 2006-267486 10/2006

OTHER PUBLICATIONS

Jackson, John David, "Classical Electrodynamics" Third Edition, 1999, John Wiley and Sons Publishing, ISBN 978-0-471-30932-1, pp. 101-103.*

(Continued)

*Primary Examiner* — Walter L Lindsay, Jr.
*Assistant Examiner* — Matthew Miller
(74) *Attorney, Agent, or Firm* — Oblon, McClelland, Maier & Neustadt, L.L.P.

(57) ABSTRACT

A transfer device including an image carrier; a transfer member disposed facing the image carrier; a transfer electrical field generator including a direct-current (DC) power source to generate a DC voltage and an alternating current (AC) power source to generate an AC voltage; and a controller. The transfer electrical field generator forms the transfer electrical field between the image carrier and the transfer member using the DC voltage and the AC voltage, to transfer the toner image on the image carrier, charged to a predetermined polarity, onto the recording medium. The controller controls the AC voltage source so that, the AC voltage output from the AC voltage source when a leading edge of the recording medium is positioned in the transfer electrical field is set larger than the AC voltage when the portion of the recording medium other than the leading edge is positioned in the transfer electrical field.

17 Claims, 12 Drawing Sheets

(56) References Cited

U.S. PATENT DOCUMENTS

| | | | | |
|---|---|---|---|---|
| 5,689,758 | A * | 11/1997 | Wataki et al. | 399/45 |
| 5,991,570 | A | 11/1999 | Haga et al. | |
| 6,405,002 | B2 | 6/2002 | Ogiyama et al. | |
| 6,618,565 | B2 | 9/2003 | Tamiya et al. | |
| 6,697,595 | B2 | 2/2004 | Kawagoe et al. | |
| 6,741,821 | B2 | 5/2004 | Sugino et al. | |
| 6,785,500 | B2 | 8/2004 | Takahashi et al. | |
| 6,829,450 | B2 | 12/2004 | Tamiya et al. | |
| 6,901,234 | B2 | 5/2005 | Ogiyama et al. | |
| 7,003,238 | B2 | 2/2006 | Yoshida et al. | |
| 7,203,433 | B2 | 4/2007 | Kato et al. | |
| 7,242,887 | B2 * | 7/2007 | Takeuchi et al. | 399/101 |
| 7,277,657 | B2 | 10/2007 | Uchida et al. | |
| 7,280,792 | B2 | 10/2007 | Sawai et al. | |
| 7,346,287 | B2 | 3/2008 | Ogiyama et al. | |
| 7,610,004 | B2 | 10/2009 | Kato et al. | |
| 7,773,928 | B2 | 8/2010 | Ogiyama et al. | |
| 7,957,656 | B2 * | 6/2011 | Moore et al. | 399/45 |
| 2003/0118359 | A1 | 6/2003 | Ogiyama et al. | |
| 2005/0180767 | A1 * | 8/2005 | Ishii et al. | 399/66 |
| 2007/0025753 | A1 * | 2/2007 | Saito et al. | 399/88 |
| 2008/0232867 | A1 | 9/2008 | Minbu et al. | |
| 2010/0040386 | A1 | 2/2010 | Mizutani et al. | |
| 2010/0080631 | A1 | 4/2010 | Ogiyama et al. | |
| 2010/0098446 | A1 | 4/2010 | Ishikawa et al. | |
| 2010/0142985 | A1 | 6/2010 | Minbe et al. | |
| 2010/0221029 | A1 | 9/2010 | Minbu et al. | |
| 2010/0303518 | A1 * | 12/2010 | Aimoto et al. | 399/314 |
| 2011/0064487 | A1 | 3/2011 | Ichihashi et al. | |
| 2011/0158690 | A1 | 6/2011 | Mimbu et al. | |
| 2011/0181116 | A1 | 7/2011 | Takeuchi et al. | |
| 2011/0206399 | A1 | 8/2011 | Fujita et al. | |
| 2011/0286759 | A1 | 11/2011 | Ichihashi et al. | |
| 2011/0293312 | A1 | 12/2011 | Mimbu et al. | |
| 2012/0008991 | A1 | 1/2012 | Shimizu | |
| 2012/0045237 | A1 | 2/2012 | Aoki et al. | |
| 2012/0045259 | A1 | 2/2012 | Nakamura et al. | |

OTHER PUBLICATIONS

Black's Law Dictionary, http://intrenetsolutions.westlaw.com/custom/blacks/ Copyright 2009 Thomson Reuters. Bryan A Carner, Editor in Chief.*

McGraw-Hill Dictionary of Scientific and Technical Terms, Sixth Edition, Copyright 2003 the McGraw-Hill Companies ISBN 0-07-042313-x.*

U.S. Appl. No. 13/472,897, filed May 16, 2012, Hiromi Ogiyama.

U.S. Appl. No. 13/417,637, filed Mar. 12, 2012, Kenji Sengoku, et al.

U.S. Appl. No. 13/477,724, filed May 22, 2012, Shimizu, et al.

U.S. Appl. No. 13/485,151, filed May 31, 2012, Shimizu, et al.

U.S. Appl. No. 13/483,536, filed May 30, 2012, Sengoku, et al.

U.S. Appl. No. 13/526,894, filed Jun. 19, 2012, Takeuchi, et al.

U.S. Appl. No. 13/527,153, filed Jun. 19, 2012, Fujita, et al.

U.S. Appl. No. 13/530,555, filed Jun. 22, 2012, Takeuchi, et al.

Office Action issued on May 12, 2015 in Japanese Patent Application No. 2011-148540.

* cited by examiner

COMPARATIVE EXAMPLE

TRANSFER DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2011-148540, filed on Jul. 4, 2011 in the Japan Patent Office, the entire disclosure of which is hereby incorporated by reference herein.

BACKGROUND

1. Technical Field

The present disclosure relates to a transfer device and an image forming apparatus incorporating the transfer device, such as a copier, a facsimile machine, a printer, or a multi-functional system including a combination thereof 2. Description of the Related Art Related-art image forming apparatuses, such as copiers, facsimile machines, printers, or multifunction printers, having at least one of copying, printing, scanning, and facsimile capabilities, typically form an image on a recording medium according to image data.

In electrophotographic image forming apparatuses, an electrostatic latent image, which is obtained by forming optical image data on an image carrier (e.g., a photoconductor) that is uniformly charged in advance, is rendered visible with toner from a development device. An image is formed on a recording medium by transferring the visible image directly or indirectly onto the recording medium (e.g., transfer sheet) via an intermediate transfer device and fixing the image thereon.

There are two types of transfer devices, a direct-transfer type and an intermediate transfer type. In an image forming apparatus containing the direct-transfer type transfer device, a toner image is formed on an image carrier (e.g., a drum-shaped or belt-shaped photoconductor) that then directly transfers the toner image onto a recording medium using a transfer member (e.g., a transfer roller).

Alternatively, the toner image is formed on the photoreceptor and then primary-transferred onto an intermediate transfer member (e.g., an intermediate transfer belt) serving as a second image carrier, after which the toner image on the intermediate transfer member is secondary-transferred onto a recording medium by the transfer member.

In above-described intermediate transfer device, when a high-asperity sheet, such as Japanese Paper, is used as the recording medium, a pattern of light and dark shading conforming to the surface condition of the recording medium may easily appear in an output image. This shading pattern appears because the toner is transferred poorly to concave portions on the surface of the recording medium, and as a result, the density of toner at the recessed portions is less than that at the convex portions. In order to solve this problem, instead of using a secondary bias composed only of a direct current voltage, a bias may be used in which a direct current voltage is superimposed on an alternating current voltage, thereby preventing the shading pattern from occurring.

Moreover, by varying the composition of the applied transfer bias voltage depending on the surface roughness and electrical resistivity (comparable to thickness) of the recording medium, deterioration in toner transfer efficiency due to too strong an electrical field generated by the transfer bias current and consequent uneven image density can be avoided. However, as the AC electrical field is strong, the discharge ability of the toner image and the recording medium become strong. If the AC electrical field is excessive, the toner image on the image carrier, charged to a predetermined polarity, is discharged, and the transfer efficiency may be reduced.

However, in a transfer device in which the toner image on the image carrier, charged to the predetermined polarity, is transferred onto the recording medium using the transfer electrical field, an electrostatic field may be formed between the recording medium and the image carrier, because the recording medium is charged by the transfer electrical field. Then, the recording medium cannot be separated from the image carrier, which causes the recording medium to be jammed.

In general, the image carrier curves sharply away from a recording medium transport path immediately downstream from a transfer zone in which the transfer electrical field is formed. Therefore, even if the recording medium is charged by the action of transfer, the rigidity of stiff recording media such as cardboard can overcome the electrostatic attraction between the image carrier and the recording medium. As a result, the recording medium goes straight without being attracted to the image carrier and bending with the curve, which prevents the sheet from jamming.

However, with pliant recording media having weak rigidity, such as thin paper, the electrostatic attraction between the recording medium and the image carrier may be stronger than the rigidity of the thin paper. Therefore, the recording medium tends to adhere to the image carrier and bend with the curve, thus deviating from the transport path and resulting in jamming.

SUMMARY

In one aspect of this disclosure, there is provided an improved transfer device to transfer toner image onto a recording medium. The transfer device includes an image carrier, a transfer member, a transfer electrical field generator, and a controller. The image carrier has a surface to bear a toner image. The transfer member, disposed facing the image carrier, causes the recording medium to contact the image carrier. The transfer electrical field generator generates a transfer electrical field that transfers the toner image on the image carrier, charged to a predetermined polarity, onto the recording medium. The transfer electrical field generator includes a direct current (DC) power source to generate a DC voltage and an alternating current (AC) power source to generate an AC voltage. The transfer electrical field generator forms the transfer electrical field between the image carrier and the transfer member using the DC voltage from the DC power source and the AC voltage from the AC power source. The controller controls the AC voltage source of the transfer electrical field generator so that the AC voltage output from the AC voltage source when a leading edge of the recording medium is positioned in the transfer electrical field is set larger than the AC voltage when the portion of the recording medium other than the leading edge is positioned in the transfer electrical field.

In another aspect of this disclosure, there is provided an improved transfer device to transfer toner image onto a recording medium. The transfer device includes an image carrier, a transfer electrical field generator, and a controller. The image carrier has a surface to bear a toner image. The transfer electrical field generator to generate a transfer electrical field that transfers the toner image on the image carrier, charged to a predetermined polarity, onto the recording medium. The transfer electrical field generator includes a direct current (DC) power source to generate a DC voltage and an alternating current (AC) power source to generate an AC voltage. The transfer electrical field generator forms a transfer electrical field between the image carrier and the transfer member using the DC voltage from the DC power source and the AC voltage from the AC power source. The controller controls the AC power source of the transfer electrical field generator so that the AC output voltage from the AC power source is turned on when a leading edge of the recording medium is positioned in the transfer electrical field, and the AC output voltage from the AC power source is turned off when the portion of the recording medium other than the leading edge is positioned in the transfer electrical field.

In yet another aspect of this disclosure, there is provided an improved image forming apparatus including an image carrier, a transfer member, a transfer electrical field generator, and a controller. The image carrier has a surface to bear a toner image. The transfer member, disposed facing the image carrier, causes the recording medium to contact the image carrier. The transfer electrical field generator generates a transfer electrical field that transfers the toner image on the image carrier, charged to a predetermined polarity, onto the recording medium. The transfer electrical field generator includes a direct-current (DC) power source to generate a DC voltage and an alternating current (AC) power source to generate an AC voltage. The transfer electrical field generator forms the transfer electrical field between the image carrier and the transfer member using the DC voltage from the DC power source and the AC voltage from the AC power source. The controller controls the AC voltage source of the transfer electrical field generator so that the AC voltage output from the AC voltage source when a leading edge of the recording medium is positioned in the transfer electrical field is set larger than the AC voltage when the portion of the recording medium other than the leading edge is positioned in the transfer electrical field.

BRIEF DESCRIPTION OF THE DRAWINGS

The aforementioned and other aspects, features, and advantages will be better understood by reference to the following detailed description when considered in connection with the accompanying drawings, wherein.

DETAILED DESCRIPTION OF PREFERRED EMBODIMENTS

Figure 1:
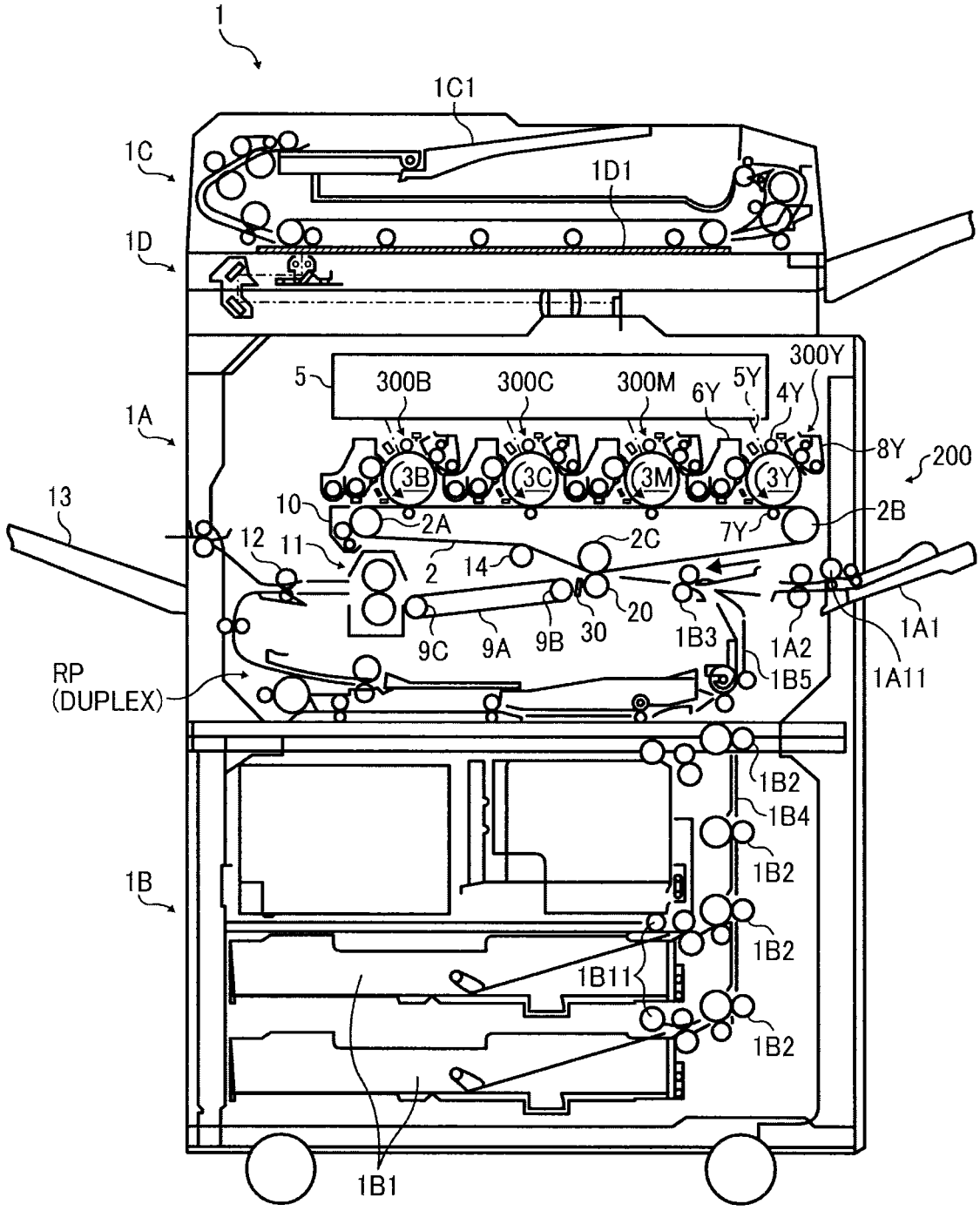
FIG. 1 is a schematic diagram illustrating an image forming apparatus according to the present disclosure.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, particularly to FIGS. 1 through 15, image forming apparatus according to illustrative embodiments are described. It is to be noted that although the image forming apparatus of the present embodiment is described as a printer, the image forming apparatus of the present invention is not limited thereto. In addition, it is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

(Configuration of Image Forming Apparatus)

With reference to FIG. 1, a configuration and operation of the tandem drum type image forming apparatus 1 is described below. In FIG. 1, the image forming apparatus 1 includes an image forming body 1A, a sheet feeder 1B positioned beneath the image forming body 1A, a document feeder 1C positioned above the image forming body 1A, and a scanner 1D. Herein, this multicolor image forming apparatus 1 has a communication function and is connected to local access network (LAN) or communication line (phone line and optical line), the image forming apparatus 1 can function as a multifunction machine used for a printer, a facsimile, and a scanner.

In FIG. 1, when a user set a document is set on a document tray 1C1 of the document feeder 1C and pushes a start key on a control panel on the image forming body 1A, the document feeder 1C transports the document to a contact glass 1D1 of the scanner 1D. Then, image on the document is read by the scanner 1D, and an image processor converts the image into image data for transmit to the image forming body 1A.

A transfer device 200 including an endless intermediate transfer belt 2 is provided in the image forming body 1A. The intermediate transfer belt 2, serving as an intermediate transfer member (image carrier), has a transfer surface extending in a horizontal direction. Four image forming stations 300Y, 300M, 300C, and 300B to form image having a complementary color corresponding to separated colors are disposed on an upper surface (primary-transfer surface) of the intermediate transfer belt 2. In these image forming stations 300, photoconductors (second image carrier) 3Y, 3M, 3C, and 3B to carry toner of yellow(Y), magenta (M), cyan(C), and black (B) are arranged along the primary-transfer surface of the intermediate transfer belt 2.

These photoconductors 3Y, 3M, 3C, and 3B are formed of rotatable drums, which rotate in same direction (counterclockwise direction). Each of the image forming stations 300Y, 300M, 300C and 300K has the same basic configuration, differing only in the color of toner used therein as an image forming material. Using the image forming station 300Y purely as an example, the configuration of the image forming stations 300Y, 300M, 300C, and 300K is described in further detail below. In the image forming station 300Y, a charging device 4Y, a development device 6Y, a primary transfer device 7Y, and a drum-cleaning device 8Y are provided on the photoconductor 3Y. The photoconductor 3Y receives a light beam 5Y from an optical writing unit 5. It is to be noted that, for ease of description, reference numerals 4, 5, 6, 7, and 8 are assigned to the charging roller, the light beam, the development device, and the drum-cleaning device, respectively, in the image forming stations 300Y for yellow, but are omitted in the image forming stations 300C, 300M and 300B in FIG. 1.

In addition, at least one of the photoconductor 3, the charging device 4, the development device 6, and the drum-cleaning device 8 may be integrally formed as single process cartridge. The process cartridge is removably installable to the image forming body 1A, which facilitates replacement and maintenance.

The development devices 6 contain respective color toner. The intermediate transfer belt 2 is wound around a driving roller 2B, a driven roller 2A, and a secondary-transfer facing roller 2C, which is rotated so that the upper transfer surface of the intermediate transfer belt 2 moves in a direction identical to the direction in which the photoconductors 3Y, 3M, 3C, and 3B rotate. A belt-cleaning device 10 to clean an outer surface of the intermediate transfer belt 2 is provided outside loop of the intermediate transfer belt 2, facing the driven roller 2A. A tension roller 14 to adjust stretching degree of the intermediate transfer belt 2 is provided outside loop of the intermediate transfer belt 2. The intermediate transfer belt 2 is sandwiched between a secondary transfer roller 20 and the secondary-transfer facing roller 2C, and a secondary transfer nip is formed therebetween.

Using the image forming station 300Y purely as an example, image forming process is described below. The charging device 4Y uniformly charges a surface of the photoconductor 3Y, and an electrostatic latent image is formed on the surface of the photoconductor 3Y, based on the image date from the scanner 1D. The development device 6Y, containing yellow toner, visualizes (develops) the electrostatic latent image to a toner image. The toner image is primary-transferred onto the outer surface of the intermediate transfer belt 2 by the primary transfer device 7Y.

The visualized image (toner image) formed and carried on other photoconductors 3C, 3M, and 3B are primary-transferred therefrom and superimposed one on another on the intermediate transfer belt 2. The residual toner adhering to the surface of the photoconductors 3Y, 3M, 3C, and 3K is removed by the drum-cleaning devices 8Y, 8M, 8C, and 8B. Then, a charge neutralizer removes residual charge remaining on the photoconductor 3Y after the surface thereof is cleaned by the drum-cleaning device 8Y in preparation for the subsequent imaging cycle.

The sheet feeding unit 1D includes one or more sheet trays 1B1 each accommodating multiple recording media P and equipped with a sheet feed roller 1B11 and a sheet feeding path 1B4 equipped with sheet-transport rollers 1B2. The sheet feed roller 1B2 picks up a top sheet from the stack of the recording media P in the sheet trays 1B1. The sheet-transport rollers 1B2 convey the recording medium P to a sheet conveyance path 1B5 of the image forming body 1A. Registration rollers 1B3 in the image forming body 1A stop feeding the recording medium P to correct skew of the recording medium P, and then towards the recording medium P timed to coincide with the arrival of the multicolor toner image formed on the recording medium P.

Herein, on right side of the image forming body 1A, a manual sheet tray 1A1 for manually feeding the recording medium P is provided. The recording medium P placed on the sheet tray 1A1 is supplied one-by-one to the registration rollers 1B3 by separation rollers 1A11 and feed rollers 1A2.

A sheet reverse mechanism RP that reverses the recording medium P is provided in a lower portion of the image forming body 1A. The reverse mechanism RP reverses the recording medium P and again sends the recording medium P to the registration roller 1B3 to print the images on both side of the recording medium P (duplex printing).

The toner image that is primary-transferred from the photoconductors 3 onto the intermediate transfer belt 2 is transported to a secondary transfer member (secondary transfer roller) 20 while being carried by the intermediate transfer belt 2. The pair of registration rollers 1B3 starts to rotate again to feed the recording medium P to the secondary transfer nip in appropriate timing such that the recording medium P is aligned with the composite toner image formed on the intermediate transfer belt 2. Then, a secondary transfer bias applicator apply a transfer bias (containing DC bias or a superimposed bias in which the AC bias is superimposed on the DC bias) to at least one of the secondary-transfer facing roller 2C and the secondary transfer roller 20, the composite toner image is transferred onto the recording medium P by a secondary transfer electric field formed between the secondary-transfer facing roller 2C and the secondary transfer roller 20 and the nip pressure applied thereto.

After the recording medium P on which the composite color toner image is formed passes through the secondary transfer nip, the recording medium P separates from the intermediate transfer belt 2 by a separation member 30 (static elastrator, e.g., charge elimination needle or elimination pawl). Then, the recording medium P is transported to a fixing device 11 by a transported device 9A including rollers 9B and 9C. The toner image is fixed on the recording medium P with heat and pressure in the fixing device 11. The recording medium P after fixing is discharged to a discharge tray 13.

(Configurations)

Next, various configurations of the transfer device 200 is described below.

FIGS. 2 through 5 are schematic diagrams illustrating the transfer device 200 and the static eliminator 30 according to variation configurations. In the transfer device 200, the transfer electrical field generator 212 includes a direct-current (DC) high-voltage power source 21 and an alternating current (AC) high-voltage power source 22, to form the secondary transfer electrical filed between the intermediate transfer belt 2 and the transfer roller 20.

Figure 2:
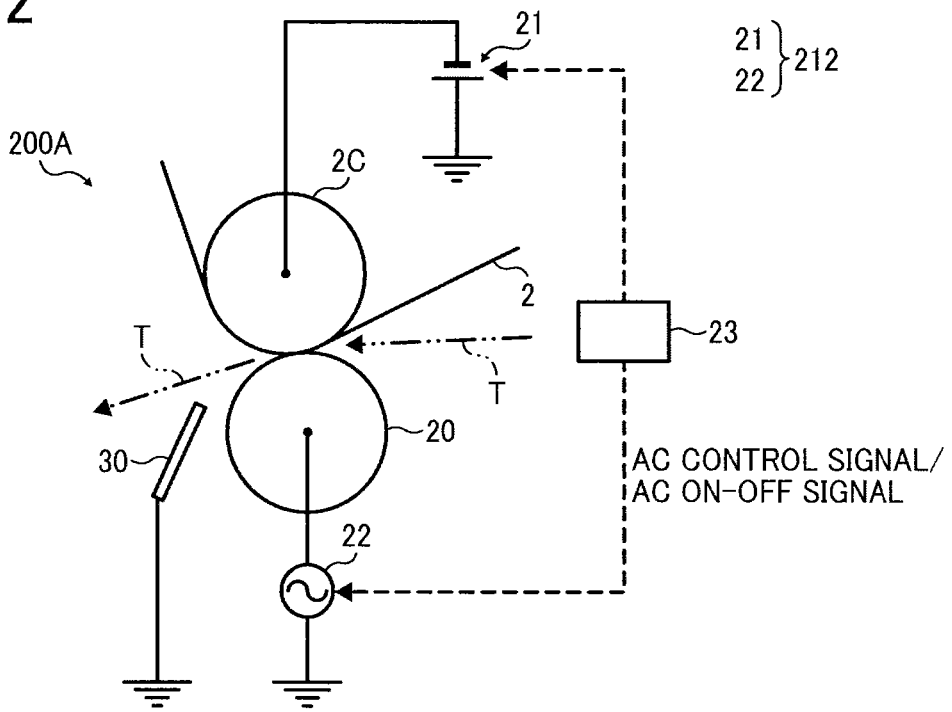
FIG. 2 is a schematic diagram illustrating a first configuration of a transfer device, a static eliminator, and connection of a transfer bias applicator.

FIG. 2 is a schematic diagram illustrating a first configuration of a transfer device 200-A and the static eliminator 30. In FIG. 2, the DC high-voltage power source 21 and the AC high-voltage power source 22 apply the voltages to different rollers. More specifically, in FIG. 2, the secondary-transfer facing roller 2C is connected to the DC high-voltage power source 21, and the secondary transfer roller 20 is connected to the AC high-voltage power source 22. In FIG. 2, the DC high-voltage power source 21 outputs a DC voltage whose polarity is identical to the toner on the intermediate transfer belt 2, charged to a predetermined (desired) polarity, to the secondary-transfer facing roller 2C. Thus, the DC high-voltage power source 21 forms an electrical field to press on the toner image from the intermediate transfer belt 2 to the recording medium P. While, the AC high-voltage power source 22 applies the AC voltage to the secondary transfer roller 20 to form an electrical field to shake the toner image on the intermediate transfer belt 2, charged to the predetermined polarity, to facilitate transfer.

Figure 3:
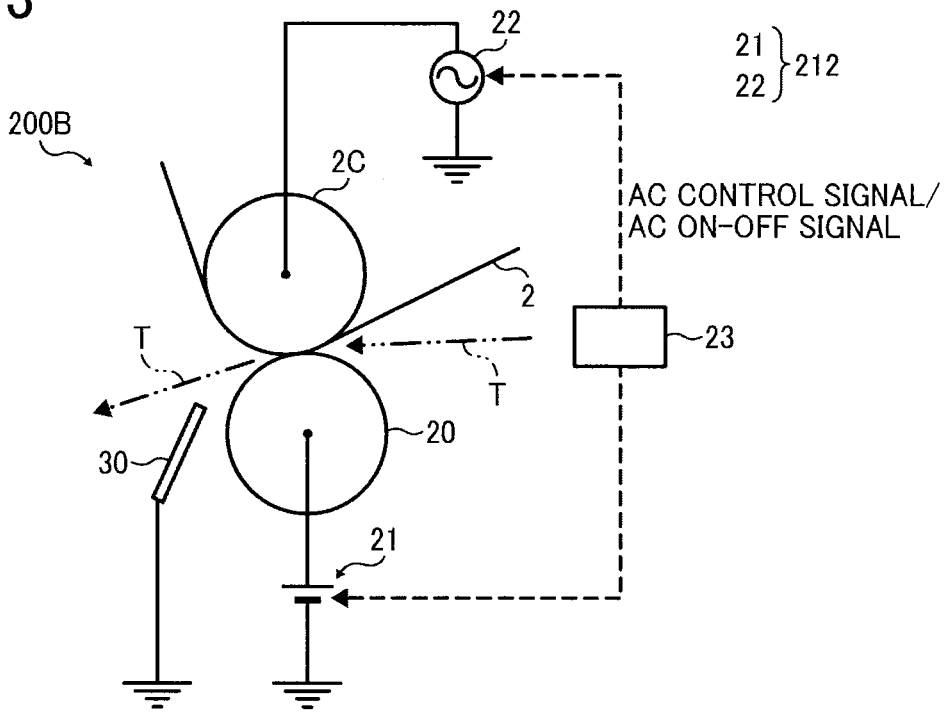
FIG. 3 is a schematic diagram illustrating a second configuration of the transfer device, the static eliminator, and the connection of the transfer bias applicator.

FIG. 3 is a schematic diagram illustrating a second configuration of a transfer device 200-B and the static eliminator 30. In FIG. 3, the DC high-voltage power source 21 and the AC high-voltage power source 22 apply the voltages to different rollers. In FIG. 3, the secondary transfer roller 20 is connected to the DC high-voltage power source 21, and the secondary-transfer facing roller 2C is connected to the AC high-voltage power source 22. In FIG. 3, the DC high-voltage power source 21 outputs a DC voltage whose polarity is opposed to the toner on the intermediate transfer belt 2, charged to a predetermined polarity, to the secondary-transfer facing roller 2C. Thus, the DC high-voltage power source 21 forms the electrical field to attract the toner image from the intermediate transfer belt 2 to the recording medium P. While, the AC high-voltage power source 22 applies the AC voltage to the secondary transfer roller 20 to form the electrical field to shake the toner image on the intermediate transfer belt 2, charged to the predetermined polarity, to facilitate transfer.

Figure 4:
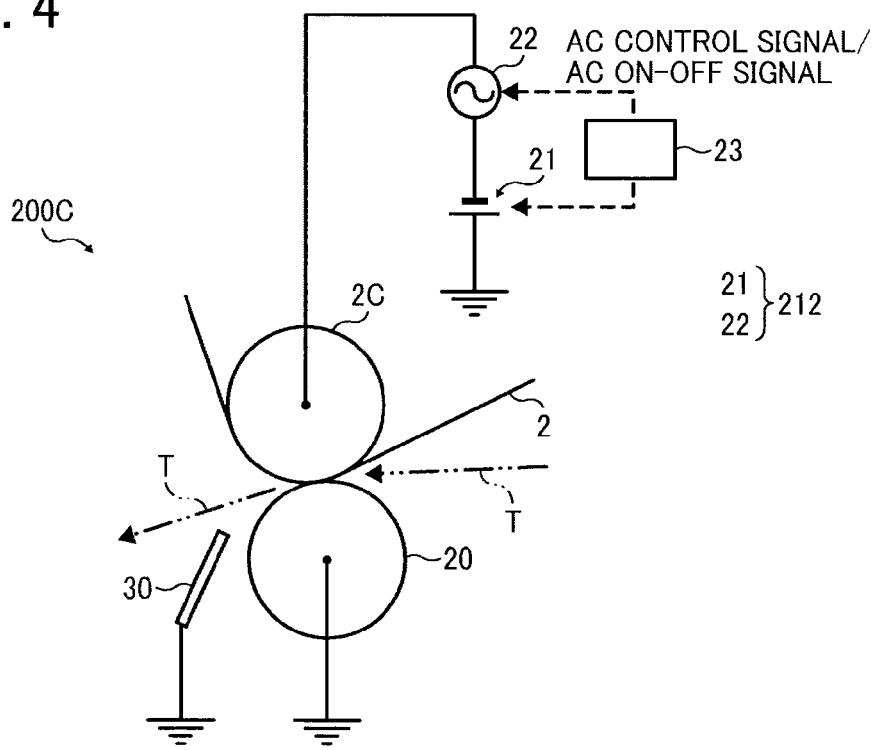
FIG. 4 is a schematic diagram illustrating a third configuration of the transfer device, the static eliminator, and the connection of the transfer bias applicator.

FIG. 4 is a schematic diagram illustrating a third configuration of a transfer device 200-C and the static eliminator 30. In FIG. 4, the DC high-voltage power source 21 and the AC high-voltage power source 22 apply the voltages to the secondary-transfer facing roller 2C. In FIG. 4, the secondary-transfer facing roller 2C is connected in serial to the DC high-voltage power source 21 and the AC high-voltage power source 22, and the secondary transfer roller 20 is electrically grounded. In FIG. 4, the DC high-voltage power source 21 that outputs a DC voltage whose polarity is identical to the toner on the intermediate transfer belt 2, charged to the predetermined polarity, and the AC high-voltage power source 22 that does not have the DC component are connected in series. Thus, a superimposed bias in which the AC voltage and the DC voltage are superimposed is applied to the secondary-transfer facing roller 2C. An average of an electrical field of the superimposed bias acts in a direction to press on the toner image from the intermediate transfer belt 2 to the recording medium P. Amplitude of the electrical field of the superimposed bias swings the charged toner image to facilitate the transfer.

Figure 5:
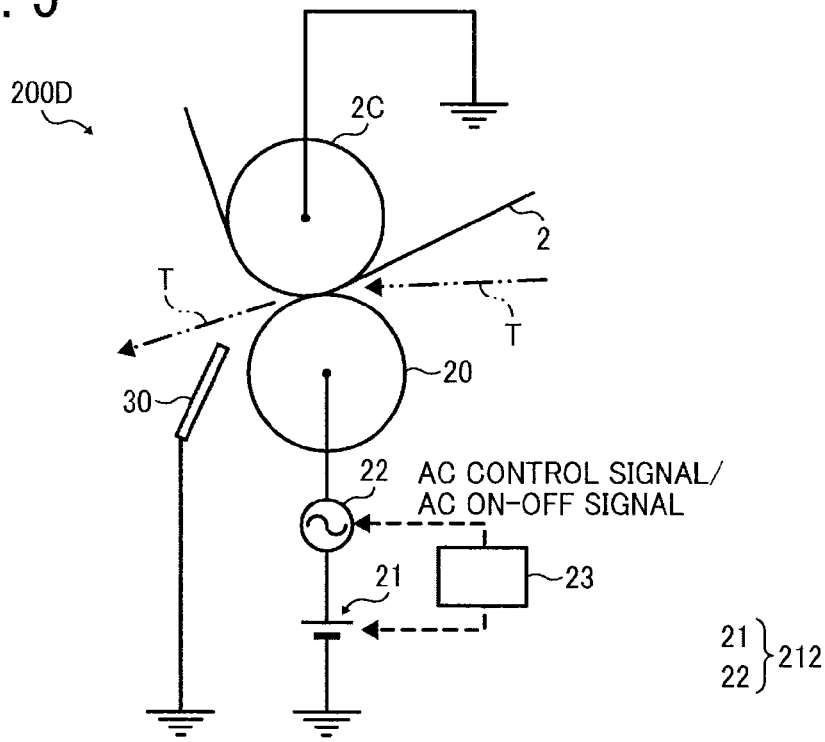
FIG. 5 is a schematic diagram illustrating a forth configuration of a transfer device, the static eliminator, and the connection of the transfer bias applicator.

FIG. 5 is a schematic diagram illustrating fourth configuration of a transfer device 200-D and the static eliminator 30. In FIG. 5, both the DC high-voltage power source 21 and the AC high-voltage power source 22 apply the voltages to the secondary transfer roller 20. In FIG. 5, the secondary transfer roller 20 is connected in serial to the DC high-voltage power source 21 and the AC high-voltage power source 22, and the secondary transfer facing roller 2C is electrically grounded. In this configuration, the DC high-voltage power source 21 that outputs a DC voltage, whose polarity is opposed to the toner on the intermediate transfer belt 2, charged to the predetermined polarity, and the AC high-voltage power source 22 that does not have the DC component are connected in series. Thus, a superimposed bias in which the AC voltage and the AC voltage are superimposed is applied to the secondary transfer roller 20. An average of an electrical field of the superimposed bias acts in a direction to attract the toner image from the intermediate transfer belt 2 to the recording medium P. Amplitude of the electrical field of the superimposed bias swings the charged toner image to facilitate transfer.

Herein, when the toner is moved from the intermediate transfer belt 2 to the recording medium P, expressions "the electrical field presses on the toner image from the intermediate transfer belt 2 to the recording medium P" and "the electrical field attracts the toner image from the intermediate transfer belt 2 to the recording medium P" are used above. These expressions are different only in consideration of the portion to which the transfer bias is applied and the applied polarity. Therefore, in both movements, the toner image is relatively transferred from the intermediate transfer belt 2 onto the recording medium P.

In any cases shown in FIGS. 2 through 5, the AC high-voltage power source 22 outputs a DC component of 0 V(volt), that is, the AC high-voltage power source 22 does not output the DC component. The AC component of the AC high-voltage power source 22 may be controlled under constant voltage control or constant current control. However, when the AC voltage is transmitted, a space circuit is formed in accordance with an electrostatic capacitance proportional to a distance between a transmission channel and the surrounding apparatus body and the current leaks into the apparatus body 1A. Therefore, the AC high-voltage power source 22 is subjected under the constant voltage control because a desired current cannot always transmit even when the AC high-voltage power source 22 is subjected under constant current control.

By contrast, the DC high-voltage power source 21 may be subjected under constant voltage control or constant current control. However, even when resistances of the members (2, 2C, 20) and the recording medium P vary, similar transfer efficiency can be obtained at the identical current. Therefore, the DC high-voltage power source 21 is generally subjected under the constant current control.

Figure 6:
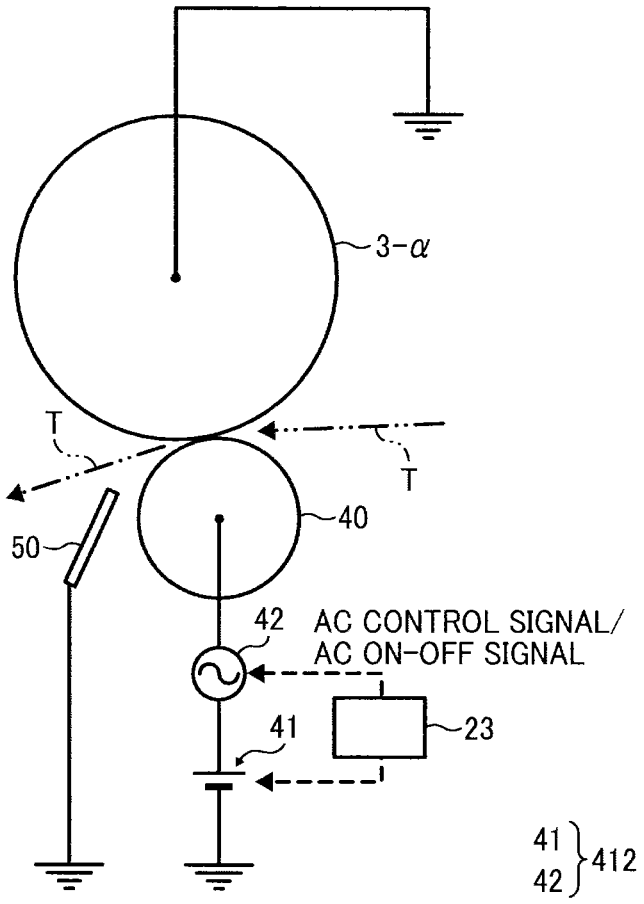
FIG. 6 is a schematic diagram illustrating a configuration of a transfer member, a static eliminator, and the connection of a transfer bias applicator using a direct transfer type.

Although the intermediate transfer belt 2 function as the image carrier as described above, alternatively, a photoconductor may function as an image carrier and the toner image on the photoconductor 3-α is directly transferred onto the recording medium P as illustrated in FIG. 6, in a direct transfer type image forming apparatus. Although the transfer bias may be applied to the photoconductor 3-α side, the charging device 4 and the development device 5 positioned vicinity of the photoconductor interfere with the transfer bias. Therefore, a conductive layer of the photoconductor 3-α is electrically grounded, and a DC high-voltage power source 41 and an AC high-voltage power source 42 are connected in series to a transfer roller 40.

In addition, similarly to the secondary transfer roller 20 shown in FIG. 5, in FIG. 6, the DC high-voltage power source 41 that outputs the DC output voltage whose polarity is opposed to that of the toner image charged to the predetermined polarity and the AC high-voltage power source 42 that does not have the DC component are connected in series. In this configuration, the superimposed bias in which the DC bias and the AC bias are superimposed is applied to the transfer roller 40. An average of the electrical field of the superimposed bias acts in the direction in which the toner image is attracted from the photoconductor 3-α to the recording medium P. Amplitude of the electrical field of the superimposed bias swings the charged toner image to facilitate transfer.

(Transfer Control)

As described above, in the transfer device 200 in which the intermediate transfer belt 2 contacts the recording medium P, and the transfer electrical field causes the toner on the intermediate transfer belt 2 (photoconductor 3-α), charged to the predetermined polarity, to transfer onto the recording medium P. If the electrostatic field is generated between the recording medium P and the intermediate transfer belt 2 caused by charging the recording medium P, the recording medium P cannot be separated from the intermediate transfer belt 2, and the jamming of the recording medium P may occur.

In these general transfer devices, the intermediate transfer belt 2 is supported by the secondary-transfer facing roller 2C where the intermediate transfer belt 2 faces the secondary transfer roller 20. With this configuration, the intermediate transfer belt 2 curves sharply away from a recording-medium transport path T immediately downstream from a transfer zone in which the transfer electrical field is formed between the intermediate transfer belt 2 and the secondary transfer roller 20. Therefore, even if the recording medium P is charged by the action of transfer, the rigidity of stiff recording media, such as a cardboard can overcome the electrostatic attraction between the intermediate transfer belt 2 and the recording medium P. As a result, the recording medium P goes straight without being adhered to the intermediate transfer belt 2 and bending with the curve, which prevents the sheet from jamming However, with pliant recording media having weak rigidity, such as thin paper, the electrostatic attraction between the recording medium P and the intermediate transfer belt 2 may be stronger than the rigidity of the thin paper. Therefore, the recording medium P is tend to adhere to the intermediate transfer belt 2 and bend with the curve, thus deviating from the transport path T, and resulting in jamming In the present disclosure of the transfer device 200 in which the transfer electrical field is formed by voltages from the DC high-voltage power source 21 and the AC high-voltage power source 22, the recording medium P is discharged by a discharge power of the AC electrical field generated from the AC high-voltage power source 22. Therefore, the electrostatic attraction between the recording medium P and the intermediate transfer belt 2 becomes weak.

With this control, the weakened electrostatic attraction between the recording medium P and the intermediate transfer belt 2 becomes further smaller than the pliant recording media having the weak rigidity. Accordingly, the recording medium P of thin paper goes straight without being adhered to the intermediate transfer belt 2 and bending with the curve, which does not jam the sheet.

However, if the output voltage of the AC high-voltage power source 22 is set sufficient large value so that the thin paper is not jammed, the toner image on the intermediate transfer belt 2, charged to the predetermined polarity, is discharged, and the transfer efficiency may be easily becomes lowered.

Herein, as long as a leading edge of the recording medium P is sufficiently discharged, the recording medium P does not adhere to the intermediate transfer belt 2 and bend with the curve. By providing the static eliminator (separation member) 30, the recording medium P is transported close to the static eliminator 30 along the transport path T, the separation member 30 attracts the recording medium P even through the static eliminator 30 is made of only a metal plate electrically connected to the ground. With this setting, even when the discharge ability is not enough for the portion of the recording medium P other than the leading edge, the recording medium P is traveled along the transport path T without jamming. Herein, the leading edge is a leading margin (leading white space) positioned outside of a print area in a direction in which the recording medium P is transported through the transfer nip. A width of the margin can be set freely by the user. The print area of the recording medium is the portion on which the image to be formed.

In this disclosure of the transfer device, the transfer bias applicator 212 is controlled such that, when the thin paper is used as the recording medium P, the sufficient large AC output voltage from the AC high-voltage power source 22 is applied to the leading edge of the recording medium P so as not to jam the recording medium P, while the sufficient small AC output voltage from the AC high-voltage power source 22 is applied to the portion of the recording medium P other than the leading edge so as not to decrease the transfer efficiency. With this control, both jamming of the recording medium and the decrease in the transfer efficiency do not occur.

In the control shown in FIGS. 7, 8, 11, and 12, the transfer device 200 (200A through 200D) to transfer toner image onto the recording medium P, including an image carrier (intermediate transfer belt 2) having a surface to bear the toner image, a transfer member (secondary transfer roller 20), a transfer electrical field generator (transfer bias applicator 212), and a controller (processor) 23. The transfer member 20 is disposed facing the image carrier (image carrier) 2, to cause the recording medium P to contact the image carrier 2. The transfer electrical field generator 212 includes a direct-current (DC) power source (DC high-voltage power source 21) to generate a DC voltage, and an alternating current (AC) power source (AC high-voltage power source 22) to generate an AC voltage. The transfer electrical field generator 212 forms a transfer electrical field between the image carrier 2 and the transfer member 20 using the DC voltage from the DC power source 21 and the AC voltage from the AC power source 22, to transfer the toner image on the image carrier 2, charged to a predetermined polarity, onto the recording medium P. The controller 23 controls the AC power source 22 so that, when the AC voltage output from the AC power source 22 when a leading edge of the recording medium P is positioned in the transfer electrical field (transfer zone) is set larger than the AC voltage when the portion of the recording medium P other than the leading edge is positioned in the transfer electrical field (transfer zone).

In addition, the AC voltage output from the AC power source 22 (when the leading edge and the portion of the recording medium P other than the leading edge are positioned in the transfer electrical field) is varied depending on the types of recording medium P.

Alternatively, in the control shown in FIGS. 9, 10, 13, 14, and 15, the controller 23 controls the AC power source 22 so that the AC output voltage from the AC power source 22 is turned on when a leading edge of the recording medium P is positioned in the transfer electrical field and the AC output voltage from the AC power source 22 is turned off when the portion of the recording medium P other than the leading edge is positioned in the transfer electrical field.

Herein, if both the transfer device 200 and the static eliminator 30 include AC high-voltage power sources respectively, the electrical field may be generated between the transfer device 200 and the static eliminator 30, and there are times when the electrical field becomes greater periodically. Leakage is likely generated in this timing.

In order to solve this problem, when the static eliminator 30 is positioned adjacent to a transfer zone where the recording medium P contacts the intermediate transfer belt 2 to transfer the toner image on the intermediate transfer belt 2 onto the recording medium P, the additional AC high-voltage power source to apply a voltage to the static eliminator 30 is not provided.

As described above, by setting the output voltage from the AC high-voltage power source 22 in the transfer device to set a greater value applied to the leading edge of the recording medium P, the recording medium P is not jammed without providing the AC high-voltage power source for the static eliminator 30. The electrical field between the transfer device 200 and the static eliminator 30 do not interfere, and the phenomena in which the electrical field that changes periodically is suddenly greater do not occur.

Accordingly, in the configuration, the jamming of the recording medium and the decrease in the transfer efficiency can be prevented, and the leakage does not occur.

Herein, in the image forming apparatus 1, although the intermediate transfer belt 2 in is used as an image carrier, alternatively, the photoconductor 3-α can be used as the image carrier, in a direct-transfer type image forming apparatus as shown in FIG. 6. More specifically, an image forming apparatus includes, an image carrier (intermediate transfer belt 2 or the photoconductor 3-α), a transfer member (20 or 40), a transfer electrical field generator (212 or 412), and a controller 23. The image carrier (2 or 3-α) has a surface to bear a toner image. The transfer member (20 or 40), disposed facing the image carrier (2 or 3-α), to cause the recording medium P to contact the image carrier (2 or 3-α). The transfer electrical field generator (212 or 412) generates a transfer electrical field that transfers the toner image on the image carrier (2 or 3-α), charged to a predetermined polarity, onto the recording medium P. The transfer electrical field generator (212 or 412) includes a direct-current (DC) power source (21 or 41) to generate a DC voltage and an alternating current (AC) power source (21 or 42) to generate an AC voltage. The transfer electrical field generator (212 or 412) forms the transfer electrical field between the image carrier (2 or 3-α) and the transfer member (20 or 40) using the DC voltage from the DC power source (21 or 41) and the AC voltage from the AC power source (22 or 42). The controller 23 controls the AC voltage source (22 or 42) of the transfer electrical field generator (212 or 412) so that the AC voltage output from the AC voltage source (22 or 42) when the leading edge of the recording medium P is positioned in the transfer electrical field is set larger than the AC voltage when the portion of the recording medium other than the leading edge is positioned in the transfer electrical field (transfer zone).

In the configuration including the photoconductor 3-α as an image carrier, using above-described transfer control, similar effect can be attained. Below description for the direct-transfer image forming apparatus shown in FIG. 6 is omitted.

(Concrete Controls)

Next, strength and timings of the output (voltage) of the AC high-voltage power source 22 are described below. Any configurations shown in FIGS. 2 through 5 can be used as the transfer device 200 and any connections of the power supplies for the controls shown in FIGS. 7 through 10 can be used for the transfer devices 200. Herein, the DC high-voltage power source 21 outputs the DC voltage (or DC current), regardless of the AC component, and the DC high-voltage power source 21 is subjected to under the constant current control (or the constant voltage control), the control of the DC high-voltage power source 21 is omitted below.

FIGS. 7 through 10 illustrate strengths and timings of the inputs and outputs of the AC high-voltage power source 22 when the thin paper is used as the recording medium P.

Figure 7:
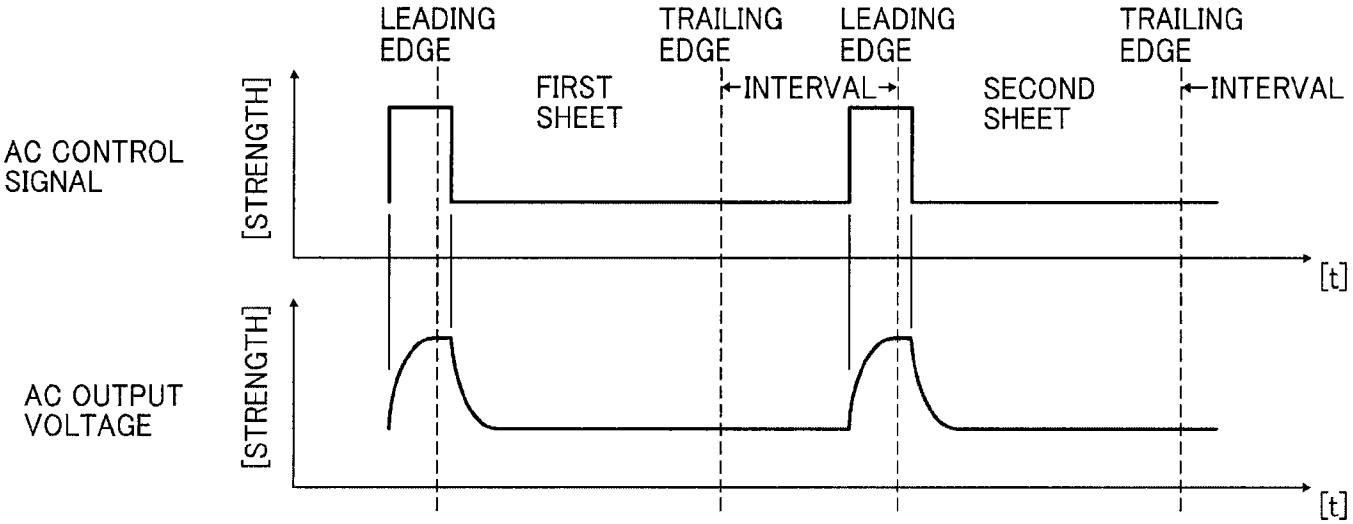
FIG. 7 is a timing chart illustrating a control of strength and timing of input and output of an AC high-voltage power source corresponding to transport timing of the recording medium when a thin paper is used as a recording medium.
Figure 8:
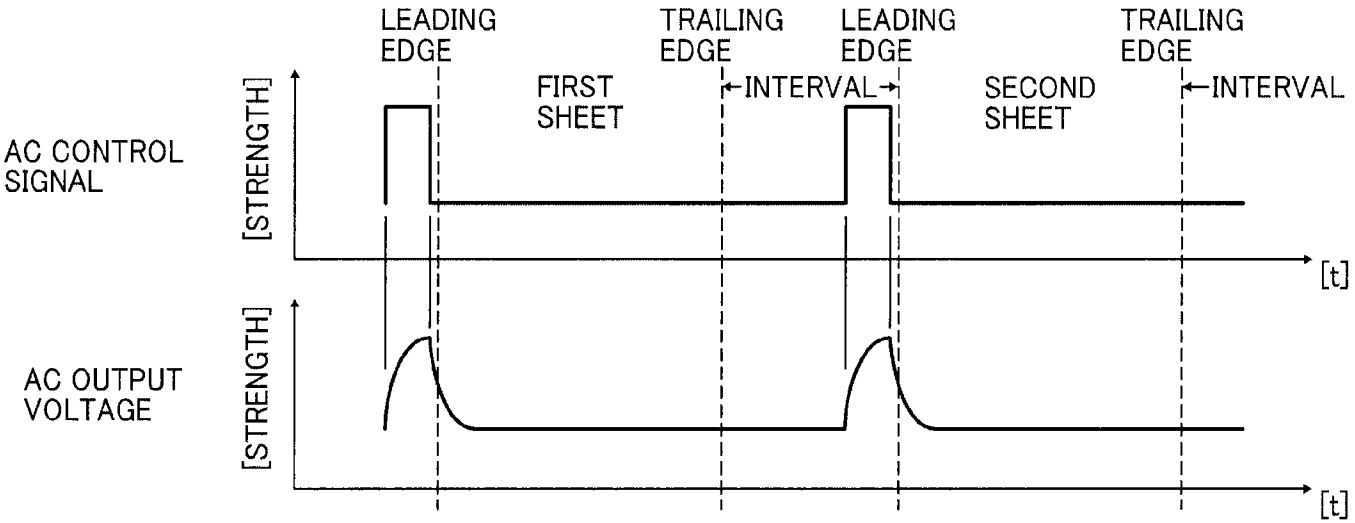
FIG. 8 is a timing chart illustrating another control of the strength and the timing of input and output of the AC high-voltage power source corresponding to transport timing of the recording medium when the thin paper is used as the recording medium.

FIGS. 7 and 8 are schematic timing charts illustrating the strengths and the timings of AC control signals input to the AC high-voltage power source 22 and the output voltage of the AC high-voltage power source 22, corresponding to transport timing of the recording medium P. In FIGS. 7 and 8, "ac control signal" represents a control signal input to the AC high-voltage power source 22 output from a controller 23 to adjust the output (voltage) of the AC high-voltage power source 22, and "AC output voltage" indicates the strength of the output voltage from the AC high-voltage power source 22 to be expected.

This signal is just conceptually illustrated in FIGS. 7 and 8. The AC control signal corresponds to a duty control signal to control duties of pulse width modulation (PWM) signal.

The AC control signal on the input side is immediately changed within 1 milli-second (mS). However, it requires several 10 mS for the output voltage of the AC high-voltage power source 22 to rise and fall after receiving the change of the input signal, as rising time and falling time. In vertical axes, the strength of the AC output voltage of the AC high-voltage power source 22 is illustrated considering change in the AC output voltage corresponding to the rising time and the falling time.

Figure 9:
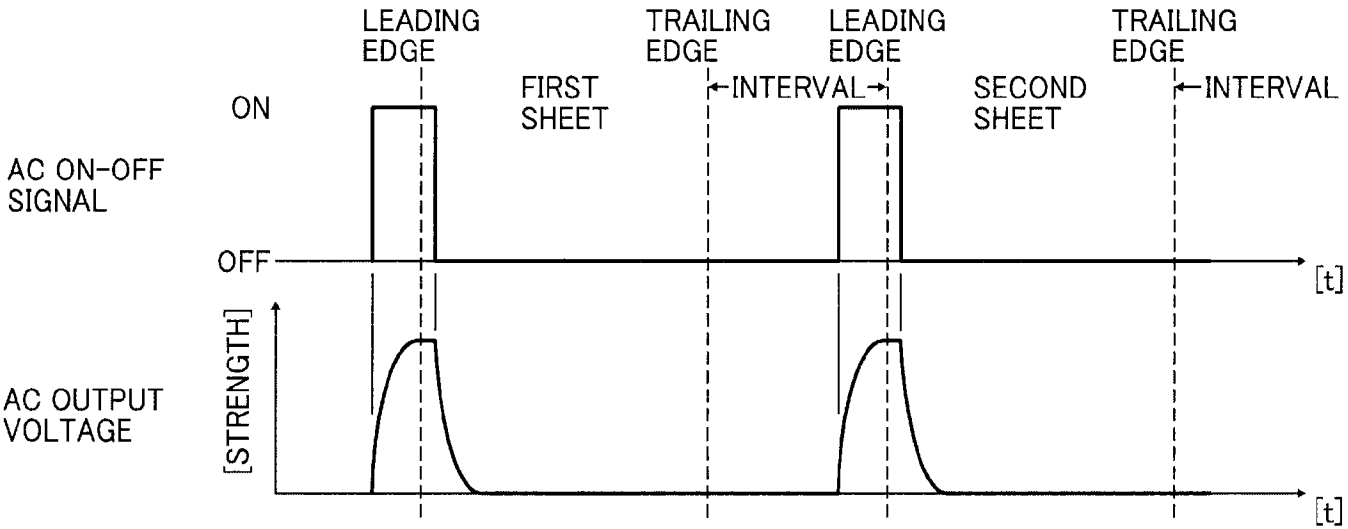
FIG. 9 is a timing chart illustrating another control of state and the timing of input and the strength and the timing of output of the AC high-voltage power source corresponding to transport timing of the recording medium when the thin paper is used as the recording medium.
Figure 10:
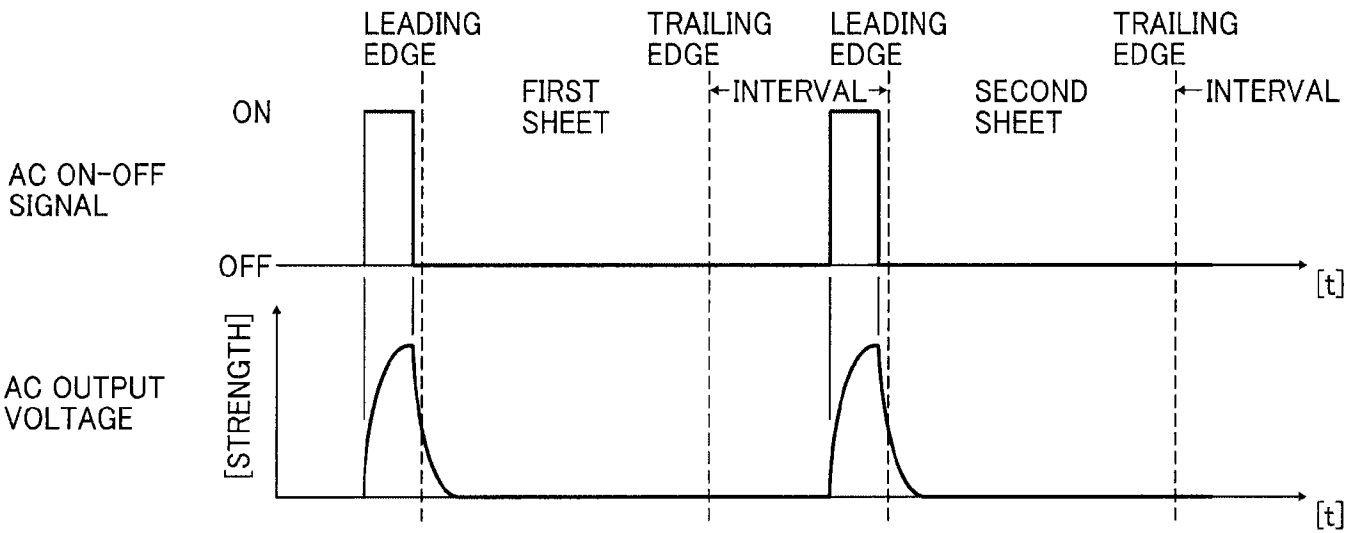
FIG. 10 is a timing chart illustrating yet another control of the state and the timing of input and the strength and the timing of output of the AC high-voltage power source corresponding to transport timing of the recording medium when the thin paper is used as the recording medium.

FIGS. 9 and 10 are schematic timing charts illustrating states of AC control signals input to the AC high-voltage power source 22 and the strengths of the output voltages of the AC high-voltage power source 22, corresponding to the transport timing of the recording medium P. In FIGS. 9 and 10, "AC on-off signal" indicates a switching signal output from the controller 23 to turn on and off the AC output voltage of the AC high-voltage power source 22. In vertical axes of the AC output voltage, the strength of the AC output voltage of the AC high-voltage power source 22 is illustrated considering the change in the AC output voltage corresponding to the rising time and the falling time.

Referring again to FIG. 7 the controller 23 controls the AC control signal such that the AC output voltage from the AC high-voltage power source 22 is set to a large value a certain time before the leading edge of the thin paper reaches the transfer zone, and after the leading edge of the thin paper passes through the transfer zone, the AC output voltage from the AC high-voltage power source 22 is decreased and then kept constant at a decreased voltage until a trailing edge of the thin paper passes through the transfer zone.

In the control shown in FIG. 9, instead of decreasing the AC output voltage of the AC high-voltage power source 22, the controller 23 causes the AC high-voltage power source 22 to turn off at the similar timing. More specifically, in FIG. 9, when the thin paper is used as the recording medium, the controller 23 switches an AC on-off signal such that the AC output voltage from the AC high-voltage power source 22 is turned on a certain time before the leading edge of the thin paper reaches a transfer zone, and after the leading edge of the thin paper passes through the transfer zone, the AC voltage output of the output of the AC high-voltage power source 22 is turned off and then is kept off state until the trailing edge of the thin paper passes through the transfer zone.

With these controls shown in FIGS. 7 and 9, the large AC electrical field, which is formed in the leading edge of the thin paper, discharges the leading edge of thin paper to weaken the electrostatic attraction between the intermediate transfer belt 2 and the thin paper. Accordingly, even though the rigidity of the pliant thin paper is weak, the electrostatic attraction between the thin paper and the intermediate transfer belt 2 becomes further weaker than the rigidity thereof Thus, the thin paper does not adhere to the intermediate transfer belt 2 and does not bend with the curve, and the thin paper goes straight along the transport path T, which prevents the sheet from being jammed.

By contrast, as the AC electrical field is weak or no presence in the print area of the thin paper, the charged toner image on the intermediate transfer belt 2 to be transferred is little discharged or not discharged, which prevents the decreases in the transfer efficiency.

However, if the input signal (AC control signal or AC on-off signal) input to the AC high-voltage power source 22 is changed so that the AC output voltage is decreased or turned off, when the falling time of the AC high-voltage power source 22 is long and the transportation velocity is high speed, the AC output voltage of the AC high-voltage power source 22 is being decreased not only when the leading edge of the thin paper passes the transfer zone but also when the print area of the thin paper passes through the transfer zone. Accordingly, transfer efficiency in a leading portion of the print area of the recording medium P may be reduced.

In such cases, different control can be performed as illustrated in FIGS. 8 and 10. In the control shown in FIG. 8, the controller 23 controls an AC control signal such that the AC output voltage of the AC high-voltage power source 22 is increased a certain time before the thin paper reaches the transfer zone, and then is decreased immediately before the thin paper enters the transfer zone so that the leading edge of the thin paper passes through the transfer zone while the AC output voltage of the AC high-voltage power source 22 is falling.

In the control shown in FIG. 10, the controller 23 switches an AC on-off signal such that the AC high-voltage power source 22 is turned off a certain time before the thin paper reaches the transfer zone, and then is turned off immediately before the thin paper enters the transfer zone so that the leading edge of the thin paper passes through the transfer zone while the AC output voltage of the AC high-voltage power source 22 is falling.

With this control, the output image on the print area of the thin paper enters the transfer zone when the AC output voltage of the AC high-voltage power source 22 completely falls. Therefore, the AC voltage output from the AC high-voltage power source 22 can discharge only the leading edge (white space) of the thin paper.

In above-described controls shown in FIGS. 7 through 11, when the thin paper is used as the recording medium P, the controller 23 controls the input signals to the AC high-voltage power source 22 such that, the sufficient large AC output voltage from the AC high-voltage power source 22 is applied to the leading edge of the recording medium P so as not to jam the recording medium, while, the sufficient small (or no) AC output voltage from the AC high-voltage power source 2 is applied to the print area of the recording medium P so as not to decrease the transfer efficiency. With these control, both the jamming of the recording medium and the decrease in the transfer efficiency can be prevented.

In addition, as the sufficient large AC output voltage from the AC high-voltage power source 22 is applied to the leading edge of the recording medium P so as not to jam the recording medium P, an AC high-voltage power source that applies AC voltage to the static eliminator 30 (separation discharge needle) does not need. With this configuration, electrical field of the transfer device does not interfere with that of the static eliminator 30, the phenomena in which the electrical field that changes periodically is suddenly greater do not occur. Accordingly, in this embodiment, the jamming of the recording medium and the decrease in the transfer efficiency and leakage can be solved.

Herein, in the image forming apparatus 1, in an interval between the trailing edge of a preceding recording medium P and a leading edge of a following recording medium P, the image forming apparatus 1 may form toner image (image patch) to perform process control to adjust image forming control in the image forming stations 300. This toner image (image patch) is called an interval pattern.

Figure 15:
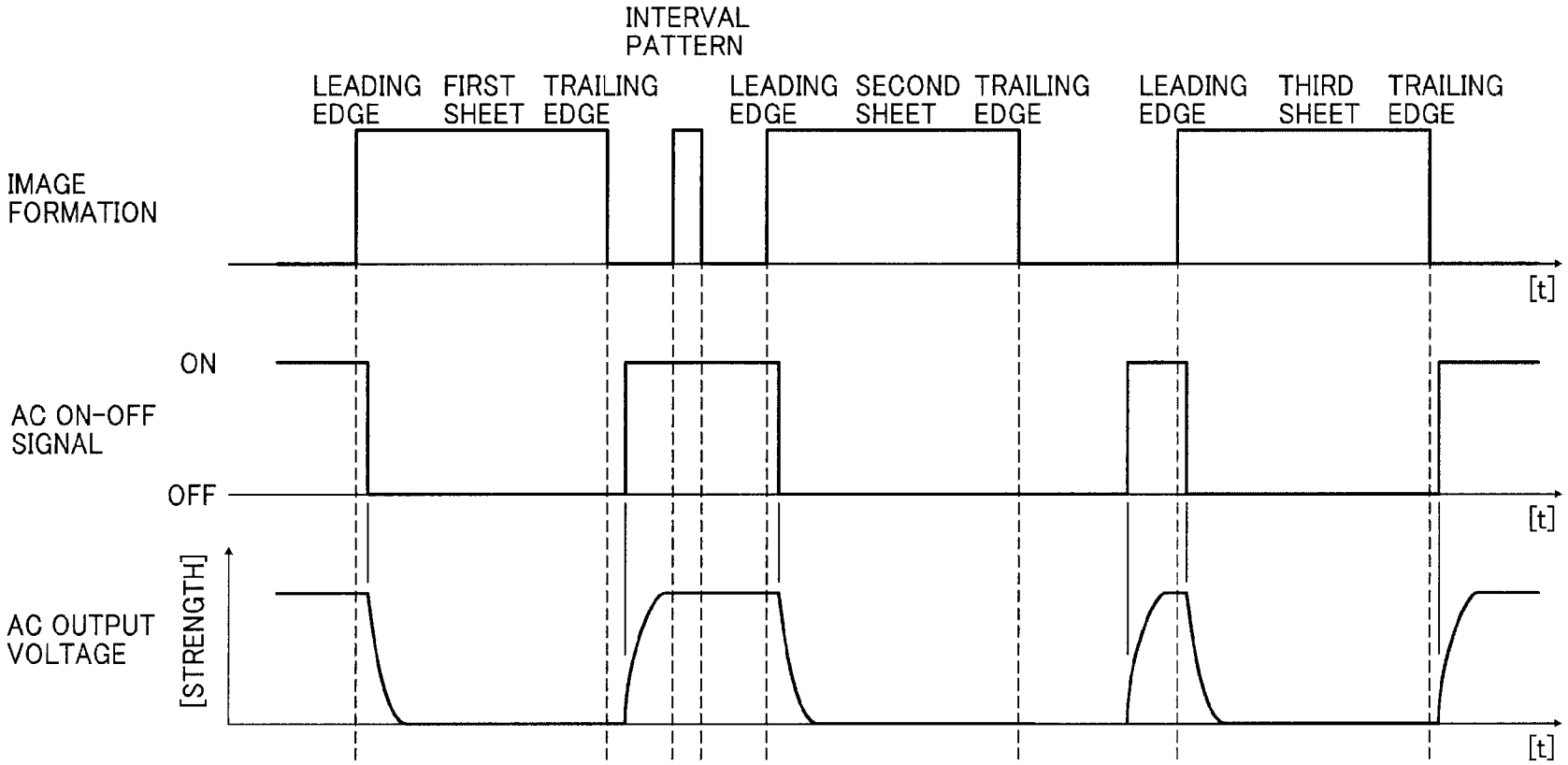
FIG. 15 is a timing chart illustrating yet another control of the state and the timing of input and the strength and the timing of output of the AC high-voltage power source corresponding to transport timing of the recording medium when the thin paper is used as the recording medium, considering presence or absence of discharge of the interval pattern.
Figure 16:
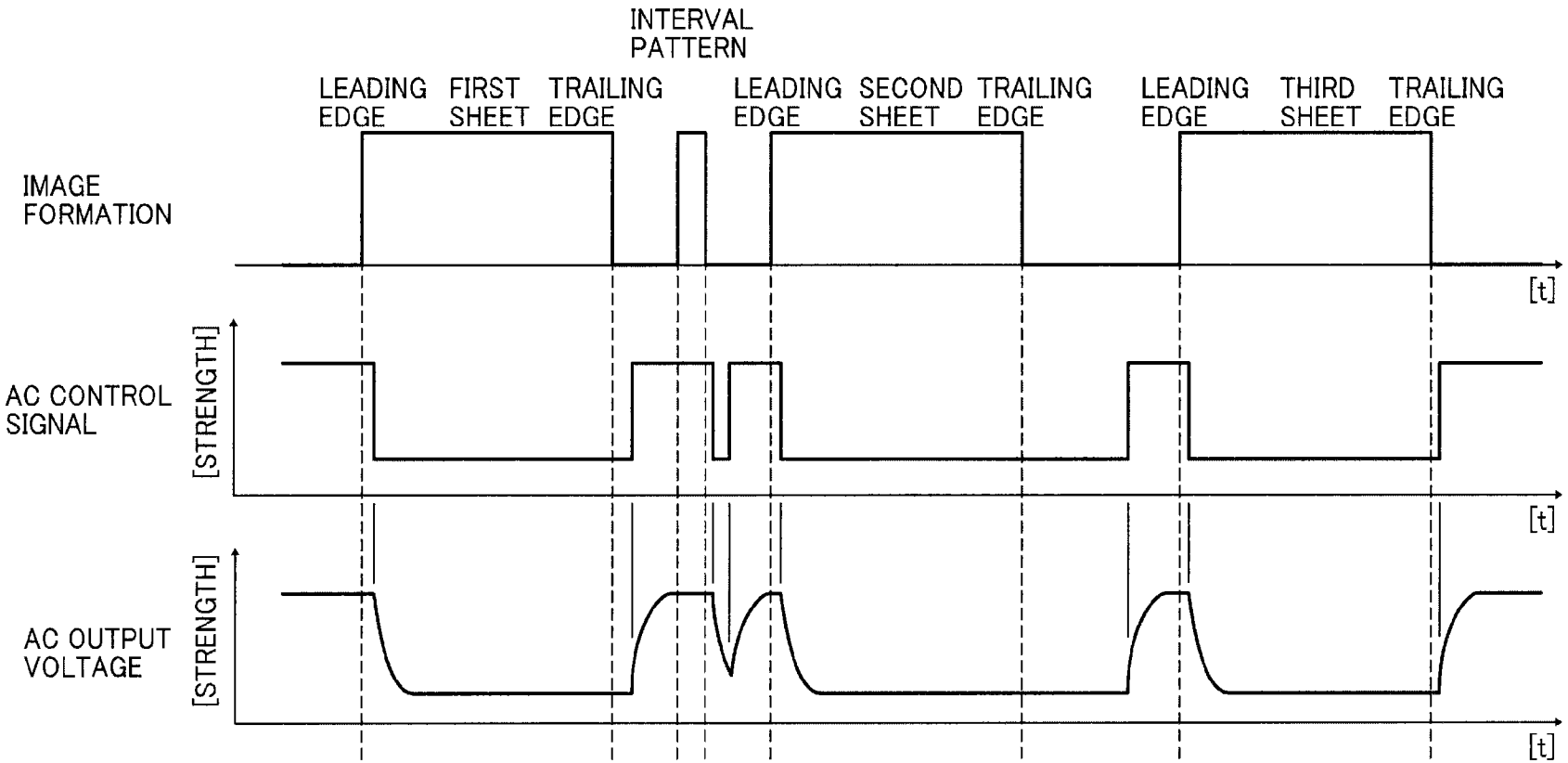
FIG. 16 is a timing chart illustrating yet another control of the strength and the timing of the input and output of the AC high-voltage power source corresponding to transport timing of the recording medium when the thin paper is used as the recording medium, considering discharge of the interval pattern, according to a comparative example.

In one comparative example of this case, a control shown in FIG. 16 can be performed. FIG. 16 illustrates the strengths and the timings of the AC control signal and the output voltage of the AC high-voltage power source 22, corresponding to transport timing of the recording medium P, when the interval pattern formed on the intermediate transfer belt 2. As illustrated in FIG. 16, the interval pattern is formed in the interval between the trailing edge of the preceding thin paper and the leading edge of the following thin paper. Other illustration and condition is similar to FIGS. 7 through 10. This interval pattern forming is used for the controls shown in FIGS. 11 through 15.

If the interval pattern is formed, it is necessary to clean the interval pattern by the belt-cleaning device 10. In order to clean properly, it is preferable that the AC output voltage of the AC high-voltage power source 22 be set large after the interval pattern passes through the transfer zone.

Herein, in the control shown in FIG. 16, considering cleaning performance by the belt-cleaning device 10, following control is performed. The controller 23 controls an AC control signal such that the AC output voltage from the AC high-voltage power source 22 is set to the large value after the trailing edge of the preceding thin paper passes through the transfer zone and before the interval pattern reaches the transfer zone, is decreased immediately after a trailing edge of the interval pattern passes through the transfer zone, is increased before the leading edge of the thin paper reaches the transfer zone, and then is decreased again immediately after the leading edge of the preceding thin paper enters the transfer zone.

However, as illustrated in FIG. 16, in general, a time required for the interval pattern to pass through the transfer zone is smaller than a time required for the recording medium P to pass through the transfer zone, and furthermore, a time from when the trailing edge of the interval pattern passes through the transfer zone to when the leading edge of the interval pattern enters the transfer zone is further shorter.

Accordingly, in the control shown in FIG. 16, even though the AC control signal to decrease the output voltage of the AC high-voltage power source 22 is input immediately after the trailing edge of the interval pattern passes through the transfer zone, the control signal to increase the output voltage of the AC high-voltage power source 22 is input in a transitional period during which the output voltage is falling before the output voltage is kept stable at a target value, and then the falling AC output voltage of the AC high-voltage power source 22 becomes greater.

Then, if the input timing of the AC control signal to increase the output voltage of the AC high-voltage power source 22 accelerates, in some cases, a soft bag that, the control signal to increase the output voltage of the AC high-voltage power source 22 is generated, before the control signal to decrease the output voltage of the AC high-voltage power source 22 is input, may occur.

Accordingly, if the control shown in FIG. 16 is performed in the image forming apparatus 1, the above-described software bug may occur. In order to prevent the occurrence of the software bug, controls shown in FIGS. 11 through 14 are performed in the image forming apparatus 1.

Figure 11:
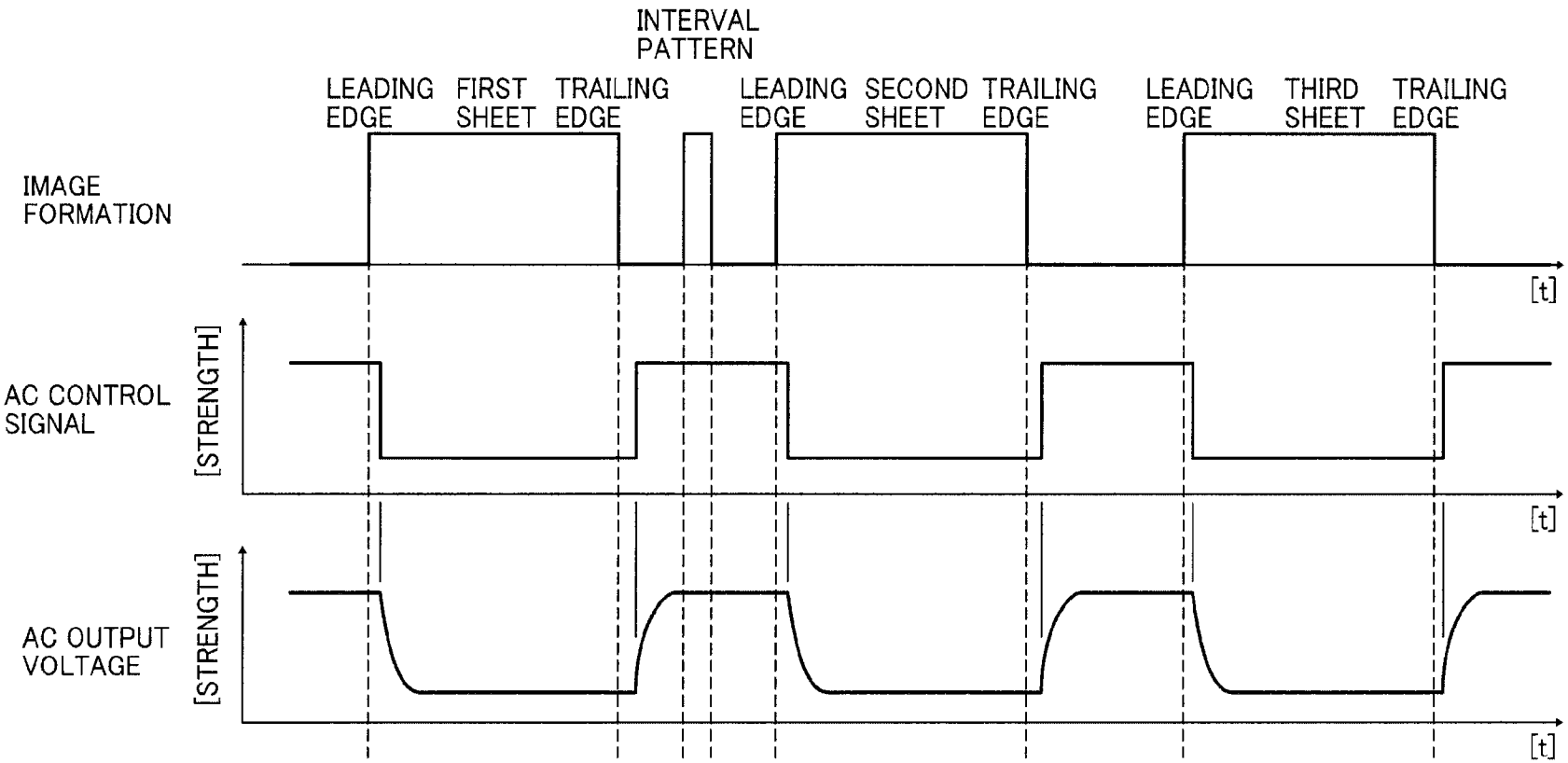
FIG. 11 is a timing chart illustrating a control of the strength and the timing of input and output of the AC high-voltage power source corresponding to transport timing of the recording medium when the thin paper is used as the recording medium, considering discharge of an interval pattern.
Figure 12:
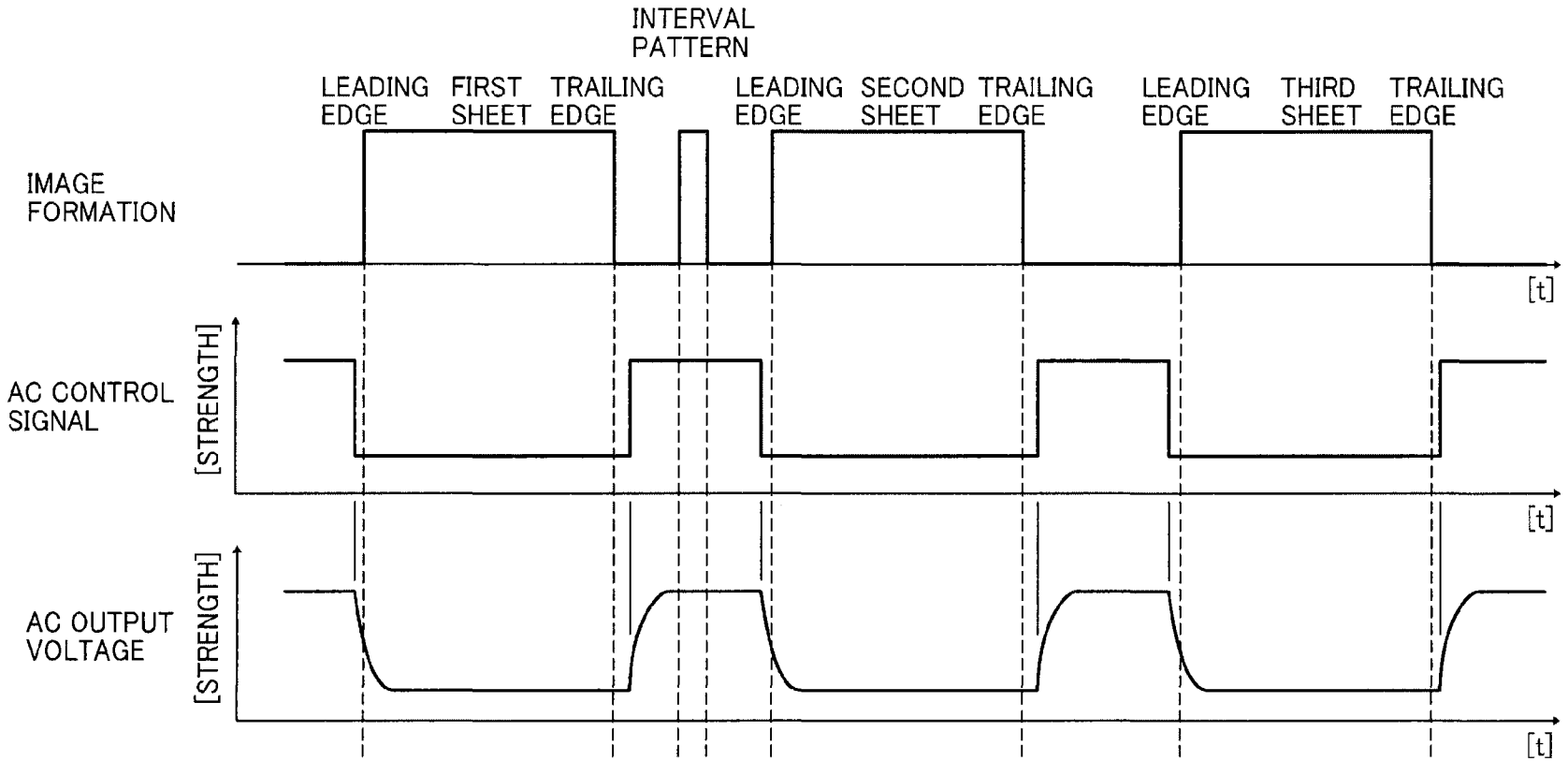
FIG. 12 is a timing chart illustrating another control of the strength and the timing of input and output of the AC high-voltage power source corresponding to transport timing of the recording medium when the thin paper is used as the recording medium, considering discharge of the interval pattern.
Figure 13:
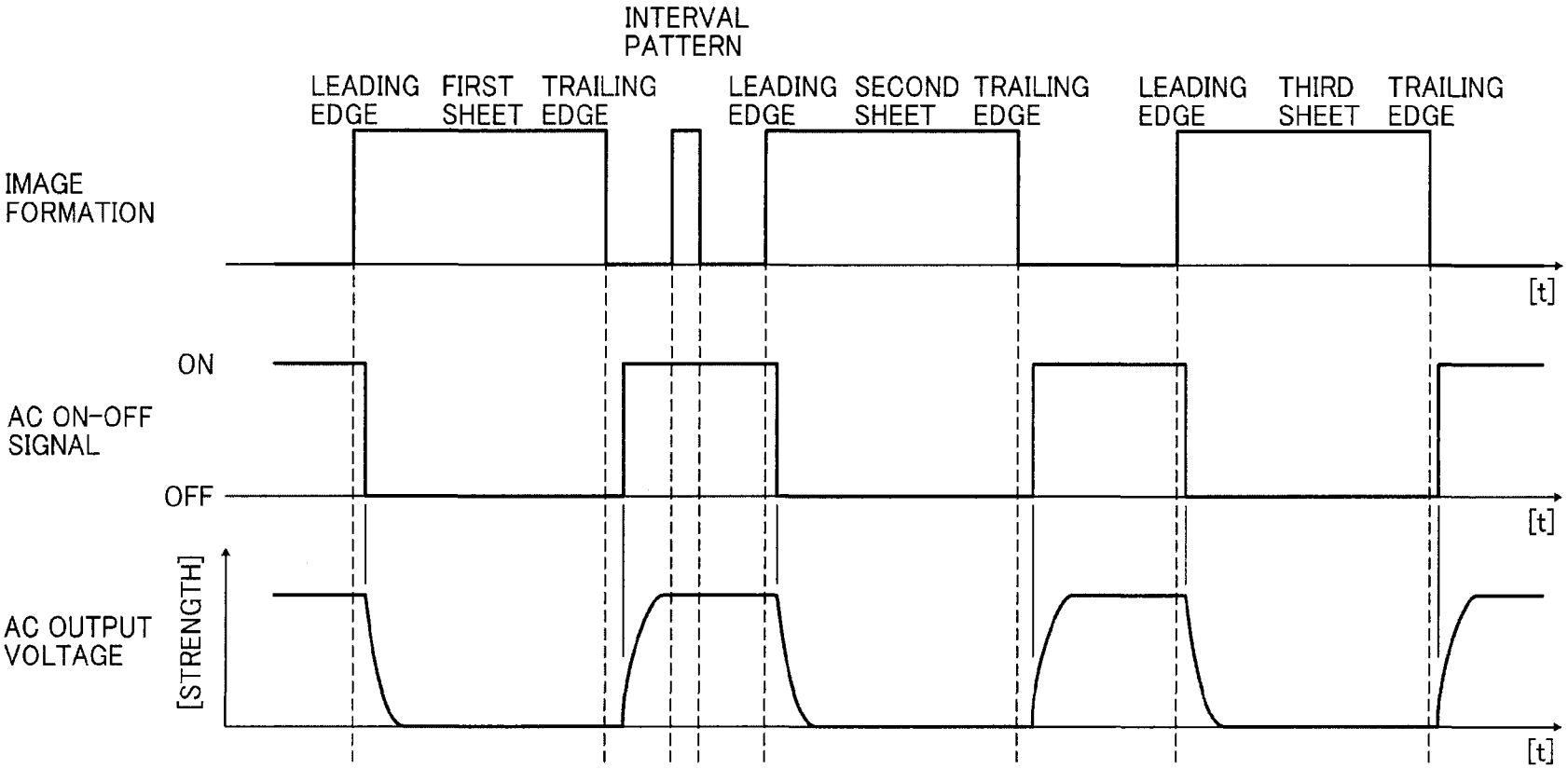
FIG. 13 is a timing chart illustrating another control of the state and the timing of input and the strength and the timing of output of the AC high-voltage power source corresponding to transport timing of the recording medium when the thin paper is used as the recording medium, considering discharge of the interval pattern.
Figure 14:
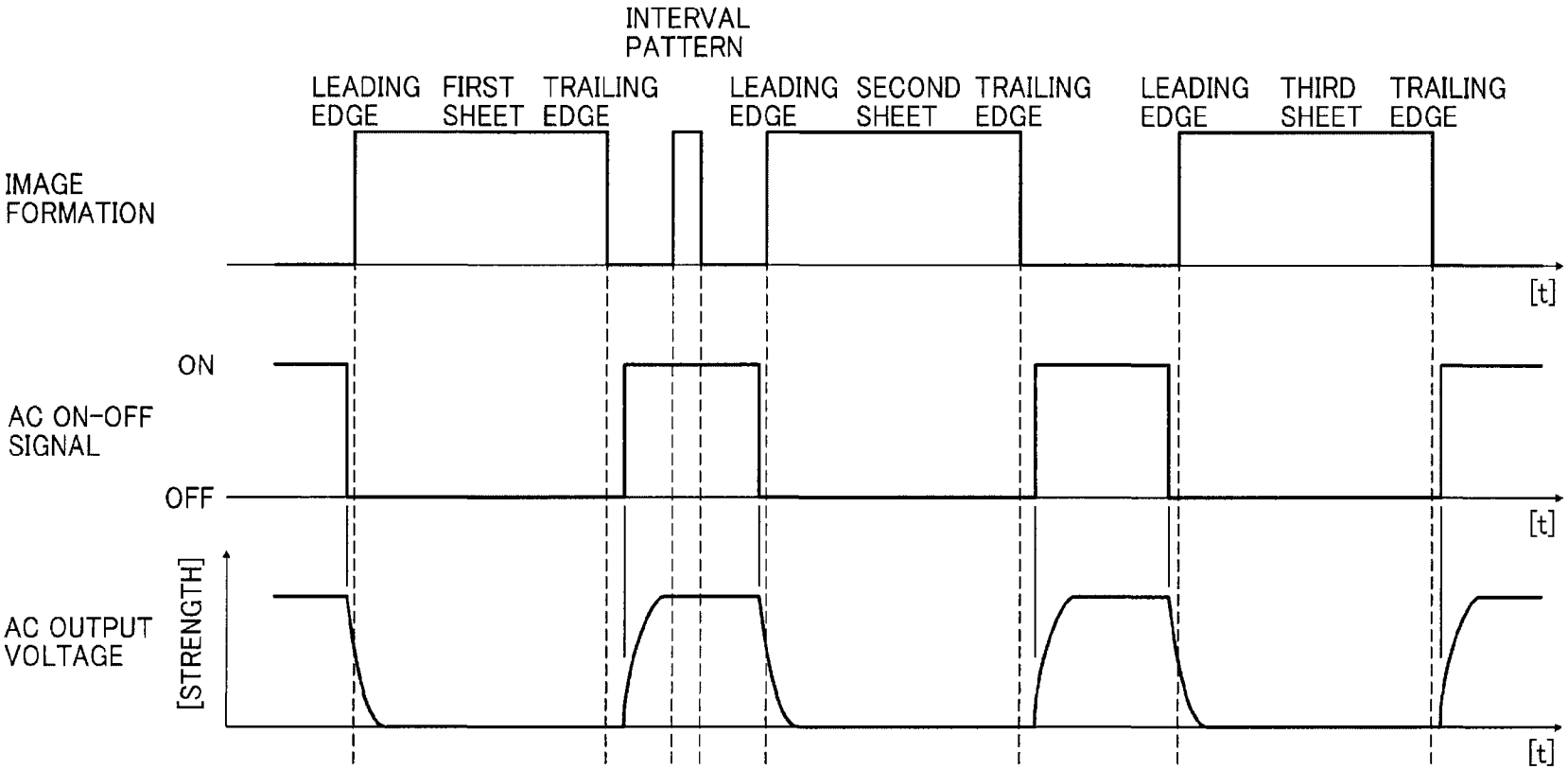
FIG. 14 is a timing chart illustrating yet another control of the state and the timing of input and the strength and the timing of output of the AC high-voltage power source corresponding to transport timing of the recording medium when the thin paper is used as the recording medium, considering discharge of the interval pattern.

The control of FIG. 11 corresponds to that of FIG. 7, the control of FIG. 12 corresponds to that of FIG. 8, the control of FIG. 13 corresponds to that of FIG. 9, and the control of FIG. 14 corresponds to that of FIG. 10.

In the control shown in FIG. 11, as a variation of the control FIG. 7, when the thin paper is used as the recording medium, the controller 23 controls an AC control signal such that the AC output voltage of the AC high-voltage power source 23 is increased after a trailing edge of a preceding recording medium passes through the transfer electrical field and then is decreased immediately after a leading edge of a following recording medium enters the transfer zone. This control shown in 11 is performed only when the toner patch (interval pattern) is formed in an interval between the preceding recording medium and the following recording medium.

With this control, the AC high-voltage power source 22 applies a great amount of AC output voltage (superimposed bias) to the transfer member 20(or 2C) to discharge the interval pattern, and then the belt cleaning device 10 successfully cleans the interval pattern. In addition, the above-described software bug does not occur, and the control can be simplified. Further, similar effect described with FIG.7 can be attained.

In FIG. 12, as a variation of the control FIG. 8, when the thin paper is used as the recording medium, the controller 23 controls an AC control signal such that the AC output voltage of the AC high-voltage power source 22 is increased after a trailing edge of a preceding recording medium passes through the transfer zone, and then is decreased immediately before a following recording medium enters the transfer zone so that a leading edge of the following recording medium enters the transfer zone while the AC output voltage of the AC high-voltage power source 22 is falling.

With this control, a superimposed bias in which a great amount of the AC output voltage from the AC high-voltage power source 22 is applied to the transfer member 20 (or 2C) to discharge the interval pattern in the transfer zone, and then the belt-cleaning device 10 successfully cleans the interval pattern. In addition, the above-described software bug does not occur, and the control can be simplified.

The control shown in FIG. 12 can be used for the case in which smaller value of the AC output voltage from the AC high-voltage power source 22 is suitable for applying to the image on the print area of the recording medium P, compared to the control shown in FIG. 11. For example, when a recording medium has characteristics such that asperity thereof is not large but smoothness thereof is low and concavities and convexities are present along paper grains in which paper fiber is flown in paper manufacturing process, the smaller value of the output voltage from the AC high-voltage power source 22 is suitable. That is, this control is suitable for a case in which the output image becomes unclear if the decreasing output voltage of the AC high-voltage power source 22 is applied to the image on the recording medium P shown in FIG. 11.

In addition, the control shown in FIG. 12 is suitable for the case in which the AC output voltage applied to the leading edge of the recording medium so as to ensure the separation performance of the recording medium from the intermediate transfer belt 2 can be smaller than the AC output applied to the interval pattern to discharge the interval pattern. In other words, the control shown in FIG. 12 is suitable for the case in which, when the AC output voltage of the AC high-voltage power source 22 to discharge the interval pattern is directly used for the AC output voltage of the AC high-voltage power source 22 applied to the leading edge of the recording medium P to ensure the separation performance of the recording medium P from the intermediate transfer belt 2, the output image may become unclear because the voltage value for discharge is too large.

Furthermore, similar effect described with FIG. 8 can be attained in the control shown in FIG. 12.

In FIG. 13, as a variation of the control FIG. 9, when the thin paper is used as the recording medium, the controller 23 switches an AC on-off signal such that the AC high-voltage power source 22 is turned on after a trailing edge of a preceding recording medium passes through the transfer zone and is turned off immediately after a leading edge of a following recording medium passes through the transfer zone.

With this control shown in FIG. 13, the superimposed bias in which the great amount of the AC output voltage from the AC high-voltage power source 22 applied to the transfer zone to discharge the interval pattern in the transfer zone, and then the belt-cleaning device 10 successfully cleans the interval pattern. In addition, the above-described software bug does not occur, and the control can be simplified. Furthermore, similar effect described with FIG. 9 can be attained.

In another respect, the control shown in FIG. 13 in which the AC high-voltage power source 22 is turned off while the image on the recording medium P is passing through the transfer zone has advantage in a case in which, even when the AC output voltage from the AC high-voltage power source 22 applied to the image on the recording medium P is small, the image may trouble by the small AC voltage, compared to the control shown in FIG. 11.

By contrast, the control shown in FIG. 11 has advantages in that time needed for to reach the target value and stable the state can be shorted, compared to the control shown in FIG. 13.

In FIG. 14, as a variation of the control FIG. 10, when the thin paper is used as the recording medium P, the controller 23 switches an AC on-off signal such that the AC high-voltage power source 22 is turned on after a trailing edge of a preceding recording medium P passes through the transfer electric field and then is turned off immediately before a following recording medium P enters the transfer electric field so that a leading edge of the following recording medium P enters the transfer electric field while the AC output voltage of the AC high-voltage power source 22 is falling.

With this control, the superimposed bias in which the great amount of the AC output voltage from the AC high-voltage power source 22 applied to the transfer zone to discharge the interval pattern in the transfer zone, and then the belt-cleaning device 10 successfully cleans the interval pattern. In addition, the above-described software bug does not occur, and the control can be simplified.

The control shown in FIG. 14 can be used for the case in which smaller value of the AC output voltage from the AC high-voltage power source 22 is suitable for applying to the image on the print area of the recording medium P, compared to the control shown in FIG. 13. For example, when a recording medium has characteristics such that asperity thereof is not large but smoothness thereof is low and concavities and convexities are present along paper grains in which paper fiber is flown in paper manufacturing process, the smaller value of the output voltage from the AC high-voltage power source 22 is suitable. That is, this control is suitable for a case in which the output image becomes unclear if the decreasing output voltage of the AC high-voltage power source 22 is applied to the image on the recording medium P shown in FIG. 13.

In addition, the control shown in FIG. 14 is suitable for the case in which the AC output voltage applied to the leading edge of the recording medium so as to ensure the separation performance of the recording medium from the intermediate transfer belt 2 can be smaller than the AC output applied to the interval pattern to discharge the interval pattern. In other words, the control shown in FIG. 14 is suitable for the case in which, when the AC output voltage of the AC high-voltage power source 22 to discharge the interval pattern is directly used for the AC output voltage of the AC high-voltage power source 22 applied to the leading edge of the recording medium P to ensure the separation performance of the recording medium P from the intermediate transfer belt 2, the output image may become unclear because the voltage value for discharge is too large.

Furthermore, similar effect described with FIG. 10 can be attained in the control shown in FIG. 14.

In another respect, the controls shown in FIG. 14 in which the AC high-voltage power source 22 is turned off while the image on the recording medium is passing through the transfer zone has advantage in a case in which, even when the AC output voltage from the AC high-voltage power source 22 applied to the image on the recording medium is small, the image may trouble by the small AC voltage, compared to the controls shown in FIG. 12.

By contrast, the control shown in FIG. 12 has advantages in that a time needed for to reach the target value and stable the state can be shorted, compared to the control shown in FIG. 14.

As described above, in the controls shown in FIGS. 11 through 14, the controller 23 outputs the AC control signal or the AC on-off signal immediately after the trailing edge of the preceding thin paper passes through the transfer zone, whether or not the interval pattern is formed, and the controller 23 controls the AC high-voltage power source 22 so that the output voltage of the AC high-voltage power source 22 is kept high state (or on state) until the leading edge of the following thin paper enters the transfer zone.

More specifically, in the controls shown in FIGS. 11 through 14, although the interval pattern is formed between a first thin paper and a second thin paper but the interval pattern is not formed between the second thin paper and a third thin paper, these controls of setting (or outputting) high level AC voltage of the AC high-voltage power source 22 during the interval are performed for any intervals.

However, in these controls, by setting high AC voltage or outputting the AC voltage from the AC high-voltage power source 22 during the interval, power is consumed even when the interval pattern is not formed. In order to save energy, as illustrated in FIG. 15, the control of setting (or outputting) high level AC voltage of the AC high-voltage power source 22 during the interval may be performed only when the interval pattern (toner image patch) is formed in the interval between the preceding recording medium P and the following recording medium P.

FIG. 15 is a timing chart illustrating the control of the state and the timing of AC on-off signal and the strength and the timing of an output voltage of the AC high-voltage power source 22 corresponding to transport timing of the recording medium, considering presence or absence of discharge of the interval pattern, this control is based on the control shown in FIG. 13. When the interval pattern is not formed, the control 23 switches an AC on-off signal such that the AC high-voltage power source 22 is turned on before the leading edge of the recording medium P enters the transfer zone. Alternatively, this control condition can be adopted for the controls shown in FIGS. 11, 12, and 14. These timing control patterns shown in 11 through 14 are performed only when the toner patch (interval pattern) is formed in an interval between the preceding recording medium P and the following recording medium P.

With these controls considering presence or absence of discharge of the interval pattern, checking whether the interval pattern is formed or not complicates the transfer control. However, using this control, power consumption can be reduced, fluctuations in the resistances of the secondary transfer roller 20, the secondary-transfer facing roller 2C (repulsive roller), and the intermediate transfer belt 2 are minimized, and the lifetimes thereof can be lengthened.

It is to be noted that, when the controls shown in FIGS. 11 through 15 are performed, it is preferable that the secondary transfer roller 20 is separated from the intermediate transfer belt 2 so that the attraction of the discharged toner constituting the interval pattern (image patch) borne on the intermediate transfer belt 2 to the secondary transfer roller 20 is prevented or alleviated. In order to prevent or alleviate the decrease in applying performance of the bias caused by this separation, it is preferable that the secondary transfer roller 20 be separated from the intermediate transfer belt 2 when the interval pattern passes through the transfer zone. While, it is preferable that the secondary transfer roller 20 be not separated from the intermediate transfer belt 2 when the leading edge of the recording medium P passes through the transfer zone. Accordingly, in order to prevent or alleviate the decrease in applying performance of the bias caused by this separation, the configurations shown in FIGS. 3 and 4 in which the AC high-voltage power source 22 is connected to the secondary-transfer facing roller 2C are preferable among the configurations shown in FIGS. 2 through 6.

Alternatively, in order to prevent or alleviate the discharged toner constituting the interval pattern (image patch) beard on the intermediate transfer belt 2 from being transferred or adhered on the secondary transfer roller 20 caused by this separation, the configurations shown in FIGS. 3 and 4 in which DC high-voltage power source 21 is connected to the secondary transfer roller 20 are preferable among the configurations shown in FIGS. 2 through 6. Considering these conditions, the configuration of FIG. 3 is most preferable.

The controller 23 may be a computer including a central processing unit (CPU) and a memory. The computer 23 also performs various types of processing to control the secondary bias, driving control to contact and separate the secondary transfer roller 20 to and from the intermediate transfer belt 2, and image forming control in the image forming stations 300, and so forth.

In addition, the material and shape of the transfer device are not limited to the above-described embodiments, and various modifications and improvements in the material and shape of the transfer device are possible without departing from the spirit and scope of the present invention.

For example, in the tandem forming type, although the transfer device is not limited to the intermediate transfer type, the transfer control can be adopted for the direct transfer type as shown in FIG. 6, that is, this transfer control shown in FIG. 6 can be adopted for a so-called single drum type color direct-transfer image forming apparatus in which respective colored toner images are formed on a photoconductive drum and the respective colors are superimposed one another on the photoconductive drum. Yet alternatively, the transfer control can be used for an image forming apparatus employing multiple intermediate transfer members (image carriers) or image forming apparatuses using neutral colored toner.

Alternatively, the image forming apparatus is not limited to the four-color image forming apparatus described above. For example, the image forming apparatus of the present disclosure may be a monochrome image forming apparatus, or color image forming apparatus producing three-color or two-color images.

It is to be noted that although two-component developer including toner and carrier is used in the above-described embodiments, the development device 8Y may contain only single-component developer consisting essentially of only toner.

It is to be noted that the configuration of the present specification is not limited to that shown in FIG. 1. For example, the configuration of the present specification may be adapted to printers including an electrophotographic image forming device as well as other types of image forming apparatuses, such as copiers, facsimile machines, multifunction peripherals (MFP), and the like.

Numerous additional modifications and variations are possible in light of the above teachings. It is therefore to be understood that, within the scope of the appended claims, the disclosure of this patent specification may be practiced otherwise than as specifically described herein.

What is claimed is:

1. A transfer device to transfer a toner image onto a recording medium, the transfer device comprising:

an image carrier having a surface to bear the toner image;

a transfer member, disposed facing the image carrier, to cause the recording medium to contact the image carrier;

a transfer electrical field generator configured to generate a transfer electrical field that transfers the toner image on the image carrier, charged to a predetermined polarity, onto the recording medium, the transfer electrical field generator comprising:

a direct current (DC) power source configured to generate a DC voltage; and an alternating current (AC) power source configured to generate an AC voltage having a strength, the transfer electrical field generator configured to form the transfer electrical field between the image carrier and the transfer member using the DC voltage from the DC power source and the AC voltage from the AC power source; and a processor configured to control the AC voltage source of the transfer electrical field generator so that the strength of the AC voltage output from the AC voltage source when a leading edge of the recording medium is positioned in the transfer electrical field is set larger than the strength of the AC voltage when a portion of the recording medium other than the leading edge is positioned in the transfer electrical field, wherein the processor is configured to:

adjust an AC control signal such that the strength of the AC output voltage generated by the AC power source is increased a certain time greater than zero before the recording medium reaches the transfer electrical field, when forming an interval pattern between successive recording mediums, adjust the AC control signal such that the strength of the AC output voltage generated by the AC power source is increased immediately after a trailing edge of a first recording medium of the recording mediums passes through the transfer electrical field and maintained at a consistent strength until after a leading edge of a second recording medium of the recording mediums enters the transfer electrical field, when forming no interval pattern between the successive recording mediums, adjust the AC control signal such that the strength of the AC output voltage generated by the AC power source is increased before the leading edge of the second recording medium enters the transfer electrical field and maintained at a consistent strength until after the leading edge of the second recording medium enters the transfer electrical field, and a time during which the strength of the AC output voltage generated by the AC power source is maintained at the consistent strength when forming the interval pattern between the successive recording mediums is greater than a time during which the strength of the AC output voltage generated by the AC power source is maintained at the consistent strength when no interval pattern is formed between the successive recording mediums.

2. The transfer device according to claim 1, wherein the strength of the AC voltage generated by the AC power source is varied depending on the type of recording medium.

3. The transfer device according to claim 1, wherein the processor is configured to adjust the AC control signal such that the strength of the AC output voltage generated by the AC power source is decreased immediately after the leading edge of the recording medium enters the transfer electrical field.

4. The transfer device according to claim 1, wherein the processor is configured to adjust the AC control signal such that the strength of the AC output voltage generated by the AC power source is decreased immediately before the recording medium enters the transfer electrical field so that the leading edge of the recording medium enters the transfer electrical field while the strength of the AC output voltage of the AC power source is falling.

5. The transfer device according to claim 1, wherein the processor is configured to adjust the AC control signal such that the strength of the AC output voltage generated by the AC power source is decreased immediately after the leading edge of the second recording medium enters the transfer electrical field.

6. The transfer device according to claim 5, wherein the adjusting of the AC control signal such that the strength of the AC output voltage generated by the AC power source is decreased immediately after the leading edge of the second recording medium enters the transfer electrical field is performed only when the interval pattern is formed between the first recording medium and the second recording medium.

7. A transfer device to transfer a toner image onto a recording medium, the transfer device comprising:

an image carrier having a surface to bear the toner image;

a transfer electrical field generator configured to generate a transfer electrical field that transfers the toner image on the image carrier, charged to a predetermined polarity, onto the recording medium, the transfer electrical field generator comprising:

a direct current (DC) power source configured to generate a DC voltage; and an alternating current (AC) power source configured to generate an AC voltage, the transfer electrical field generator configured to form the transfer electrical field at the image carrier using the DC voltage from the DC power source and the AC voltage from the AC power source; and a processor configured to control the AC power source of the transfer electrical field generator so that the AC output voltage from the AC power source is turned on when a leading edge of the recording medium is positioned in the transfer electrical field, and the AC output voltage from the AC power source is turned off when a portion of the recording medium other than the leading edge is positioned in the transfer electrical field, wherein the processor is configured to:

switch an AC on-off signal such that the AC power source is turned on a certain time greater than zero before the recording medium reaches the transfer electrical field, when forming an interval pattern between successive recording mediums, switch the AC on-off signal such that the AC power source is turned on immediately after a trailing edge of a first recording medium of the recording mediums passes through the transfer electrical field and maintained at a consistent strength until after a leading edge of a second recording medium of the recording mediums enters the transfer electrical field, when forming no interval pattern between the successive recording mediums, switch the AC on-off signal such that the AC power source is turned on before the leading edge of the second recording medium enters the transfer electrical field and maintained at a consistent strength until after the leading edge of the second recording medium enters the transfer electrical field, and a time during which the AC power source is maintained at the consistent strength when forming the interval pattern between the successive recording mediums is greater than a time during which the AC power source is maintained at the consistent strength when no interval pattern is formed between the successive recording mediums.

8. The transfer device according to claim 7, wherein the processor is configured to switch the AC on-off signal such that the AC power source is turned off immediately after the leading edge of the recording medium passes through the transfer electrical field.

9. The transfer device according to claim 7, wherein the processor is configured to switch the AC on-off signal such that the AC power source is turned off immediately before the recording medium enters the transfer electrical field so that the leading edge of the recording medium enters the transfer electrical field while the AC output voltage of the AC power source is falling.

10. The transfer device according to claim 7, wherein the processor is configured to switch the AC on-off signal such that the AC power source is turned off immediately after the leading edge of the second recording medium enters the transfer electrical field.

11. The transfer device according to claim 10, wherein the switching of the AC on-off signal such that the AC power source is turned off immediately after the leading edge of the second recording medium enters the transfer electrical field is performed only when the interval pattern is formed between the first recording medium and the second recording medium.

12. An image forming apparatus comprising:

an image carrier having a surface to bear a toner image;

a transfer member, disposed facing the image carrier, to cause a recording medium to contact the image carrier;

a transfer electrical field generator configured to generate a transfer electrical field that transfers the toner image on the image carrier, charged to a predetermined polarity, onto the recording medium, the transfer electrical field generator comprising:

a direct-current (DC) power source configured to generate a DC voltage; and an alternating current (AC) power source configured to generate an AC voltage having a strength, the transfer electrical field generator configured to form the transfer electrical field between the image carrier and the transfer member using the DC voltage from the DC power source and the AC voltage from the AC power source; and a processor configured to control the AC voltage source of the transfer electrical field generator so that the strength of the AC voltage output from the AC voltage source when a leading edge of the recording medium is positioned in the transfer electrical field is set larger than the strength of the AC voltage when a portion of the recording medium other than the leading edge is positioned in the transfer electrical field, wherein the processor is configured to adjust an AC control signal such that the strength of the AC output voltage generated by the AC power source is increased a certain time greater than zero before the recording medium reaches the transfer electrical field, when forming an interval pattern between successive recording mediums, adjust the AC control signal such that the strength of the AC output voltage generated by the AC power source is increased immediately after a trailing edge of a first recording medium of the recording mediums passes through the transfer electrical field and maintained at a consistent strength until after a leading edge of a second recording medium of the recording mediums enters the transfer electrical field, when forming no interval pattern between the successive recording mediums, adjust the AC control signal such that the strength of the AC output voltage generated by the AC power source is increased before the leading edge of the second recording medium enters the transfer electrical field and maintained at a consistent strength until after the leading edge of the second recording medium enters the transfer electrical field, and a time during which the strength of the AC output voltage generated by the AC power source is maintained at the consistent strength when forming the interval pattern between the successive recording mediums is greater than a time during which the strength of the AC output voltage generated by the AC power source is maintained at the consistent strength when no interval pattern is formed between the successive recording mediums.

13. The image forming apparatus according to claim 12, further comprising a static eliminator, positioned adjacent to the transfer member and downstream from the transfer member in a direction in which the recording medium is transported, configured to separate the recording medium from the image carrier, the static eliminator not being connected to an AC power source to separate the recording medium from the image carrier.

14. The image forming apparatus according to claim 12, further comprising:

a second image carrier having a surface on which the toner image is formed, wherein the image carrier comprises an intermediate transfer member having a surface on which the toner image from the second image carrier is transferred, wherein the transfer member is disposed opposite and facing the intermediate transfer member.

15. The image forming apparatus according to claim 12, wherein the image carrier comprises a photoconductor to form and bear the toner image, and the transfer member is disposed opposite and facing the photoconductor to transfer the toner image on the photoconductor to the recording medium.

16. An image forming apparatus comprising:

an intermediate transfer belt to bear a toner image charged to a predetermined polarity;

a transfer roller to contact with the intermediate transfer belt, a transfer nip being formed between the intermediate transfer belt and transfer roller;

a direct-current (DC) power source configured to generate a DC voltage, the DC voltage having a polarity that transfers the toner image from the intermediate transfer belt onto a recording sheet;

an alternating current (AC) power source configured to generate an AC voltage; and a processor configured to control the AC power source so that a first strength of the AC voltage output from the AC power source when a leading edge of the recording sheet is positioned in the transfer nip is larger than a second strength of the AC voltage output from the AC power source when a portion of the recording sheet other than the leading edge is positioned in the transfer nip, wherein the transfer roller is connected in serial to the DC power source and the AC power source, and wherein the processor is configured to:

adjust an AC control signal such that a strength of the AC voltage generated by the AC power source is increased to the first strength a certain time greater than zero before the recording medium reaches the transfer nip, when forming an interval pattern between successive recording mediums, adjust the AC control signal such that the strength of the AC output voltage generated by the AC power source is increased to the first strength immediately after a trailing edge of a first recording medium of the recording mediums passes through the transfer nip and maintained at the first strength until after a leading edge of a second recording medium of the recording mediums enters the transfer nip, when forming no interval pattern between the successive recording mediums, adjust the AC control signal such that the strength of the AC output voltage generated by the AC power source is increased to the first strength before the leading edge of the second recording medium enters the transfer nip and maintained at the first strength until after the leading edge of the second recording medium enters the transfer nip, and a time during which the strength of the AC output voltage generated by the AC power source is maintained at the first strength when forming the interval pattern between the successive recording mediums is greater than a time during which the strength of the AC output voltage generated by the AC power source is maintained at the first strength when no interval pattern is formed between the successive recording mediums.

17. An image forming apparatus comprising:

an intermediate transfer belt to bear a toner image charged to a predetermined polarity;

a transfer roller to contact with the intermediate transfer belt, a transfer nip being formed between the intermediate transfer belt and transfer roller;

a transfer facing roller disposed facing the transfer roller via the intermediate transfer belt;

a direct-current (DC) power source configured to generate a DC voltage, the DC voltage having a polarity that transfers the toner image from the intermediate transfer belt onto a recording sheet;

an alternating current (AC) power source configured to generate an AC voltage; and a processor configured to control the AC power source so that a first strength of the AC voltage output from the AC power source when a leading edge of the recording sheet is positioned in the transfer nip is larger than a second strength of the AC voltage output from the AC power source when a portion of the recording sheet other than the leading edge is positioned in the transfer nip, wherein the transfer facing roller is connected in serial to the DC power source and the AC power source, and wherein the processor is configured to:

adjust an AC control signal such that a strength of the AC voltage generated by AC power source is increased to the first strength a certain time greater than zero before the recording medium reaches the transfer nip, when forming an interval pattern between successive recording mediums, adjust the AC control signal such that the strength of the AC output voltage generated by the AC power source is increased to the first strength immediately after a trailing edge of a first recording medium of the recording mediums passes through the transfer nip and maintained at the first strength until after a leading edge of a second recording medium of the recording mediums enters the transfer nip, when forming no interval pattern between the successive recording mediums, adjust the AC control signal such that the strength of the AC output voltage generated by the AC power source is increased to the first strength before the leading edge of the second recording medium enters the transfer nip and maintained at the first strength until after the leading edge of the second recording medium enters the transfer nip, and a time during which the strength of the AC output voltage generated by the AC power source is maintained at the first strength when forming the interval pattern between the successive recording mediums is greater than a time during which the strength of the AC output voltage generated by the AC power source is maintained at the first strength when no interval pattern is formed between the successive recording mediums.

* * * * *